US008892469B2

(12) United States Patent
Goldstein et al.

(10) Patent No.: US 8,892,469 B2
(45) Date of Patent: Nov. 18, 2014

(54) GAMING DEVICE SECURITY MECHANISM

(75) Inventors: Floyd R. Goldstein, Grass Valley, CA (US); John Goodman, Reno, NV (US)

(73) Assignee: IGT, Las Vegas, NV (US)

( * ) Notice: Subject to any disclaimer, the term of this patent is extended or adjusted under 35 U.S.C. 154(b) by 1133 days.

(21) Appl. No.: 12/416,608

(22) Filed: Apr. 1, 2009

(65) Prior Publication Data

US 2010/0255902 A1 Oct. 7, 2010

(51) Int. Cl.
*G06Q 99/00* (2006.01)
*G07F 17/32* (2006.01)

(52) U.S. Cl.
CPC ..... *G07F 17/3232* (2013.01); *G06Q 2220/10* (2013.01); *G07F 17/32* (2013.01); *G07F 17/3234* (2013.01); *G07F 17/3241* (2013.01)
USPC ..... 705/50; 463/29

(58) Field of Classification Search
USPC ..... 705/50; 463/29
See application file for complete search history.

(56) References Cited

U.S. PATENT DOCUMENTS

| | | | | |
|---|---|---|---|---|
| 6,553,336 | B1 * | 4/2003 | Johnson et al. | 702/188 |
| 6,641,484 | B2 | 11/2003 | Oles et al. | |
| 7,722,468 | B2 * | 5/2010 | Cockerille et al. | 463/43 |
| 7,839,289 | B2 * | 11/2010 | Chung et al. | 340/572.8 |
| 2004/0212500 | A1 * | 10/2004 | Stilp | 340/541 |
| 2006/0030409 | A1 | 2/2006 | Lechner et al. | |
| 2006/0205515 | A1 * | 9/2006 | Cockerille et al. | 463/43 |
| 2006/0252530 | A1 | 11/2006 | Oberberger et al. | |
| 2007/0155512 | A1 * | 7/2007 | Wells et al. | 463/46 |
| 2007/0241878 | A1 * | 10/2007 | Jobe et al. | 340/506 |
| 2007/0268138 | A1 * | 11/2007 | Chung et al. | 340/572.1 |
| 2008/0220880 | A1 * | 9/2008 | Barrie et al. | 463/42 |
| 2008/0280664 | A1 * | 11/2008 | Canterbury et al. | 463/16 |

* cited by examiner

*Primary Examiner* — James D Nigh
(74) *Attorney, Agent, or Firm* — Foley & Lardner LLP

(57) ABSTRACT

At least one aspect disclosed herein relates to a wager-based gaming device which includes a security monitoring and reporting system. In at least one embodiment, the security monitoring/reporting system may be configured or designed to automatically monitor various conditions, events, and/or activities at the gaming device for various types of security-related issues, and to automatically and/or dynamically report the detection of security-related issues to one or more devices, systems and/or other entities.

21 Claims, 9 Drawing Sheets

600

GAMING DEVICE SECURITY MECHANISM

BACKGROUND

In Casino gaming environments, it is generally known that there are number of reasons for maintaining strict security for a gaming machine. Players and thieves attempt to cheat gaming machines in a variety of ways to obtain fraudulent payouts or otherwise directly steal monies from these machines. Thieves attempt to alter the play of the machine, access coin or bill storage devices in the machine, and pass counterfeit bills and coins, among other things. In some instances, even gaming employees attempt to steal from a gaming machine, such as by taking monies from the machine during a coin or bill drop exchange. Gaming employees may also tamper with the internal mechanisms of the gaming machine.

Casinos employ a wide variety of security measures with respect to gaming machines. Commonly, casinos mount cameras to the ceiling of the casino. These cameras are directed at banks of gaming machines and are used to monitor those machines. Casinos may also employ roving personnel to watch players and gaming machines.

SUMMARY

Various aspects described or referenced herein are directed to different methods, systems, and computer program products for operation of a gaming device in a casino gaming network. In at least one embodiment, the gaming device includes: a gaming controller; memory; a first display; at least one interface for communicating with at least one other device in the gaming network; a gaming device housing including a door, said door movable between an open position and a closed position, said housing when said door is in said closed position defining an interior area housing one or more devices and said door in said open position permitting access to said interior area; and a first security system disposed at the interior area. In at least one embodiment, the first security system includes a first processor, first memory, first portable power source, at least one interface including a first wireless communication interface, and at least one sensor including a first sensor. In at least one embodiment, the gaming device is operable to control a wager-based game played at the gaming device. In at least one embodiment, the first security system is operable to: monitor events and/or conditions at the gaming device for detection of at least one security-related event and/or condition; automatically update a current power mode of operation of the security system; record selected information associated with events and/or conditions detected at the gaming device; engage in wireless communication with a first remote system which is located external to the gaming device; and implement commands or instructions received from the first remote system.

Other aspects described or referenced herein are directed to different methods, systems, and computer program products for operation of a gaming device in a casino gaming network. In at least one embodiment, the gaming device includes: a gaming controller; memory; a first display; at least one interface for communicating with at least one other device in the gaming network; and a first security system. In at least one embodiment, the gaming device is operable to control a wager-based game played at the gaming device. In at least one embodiment, the first security system is operable to: detect a first event relating to the gaming device, the first detected event having associated therewith a first set of data; analyze the first set of data with respect to a first set of criteria in order to evaluate whether the first detected event corresponds to a critical security event which meets or exceeds specified threshold security criteria; and perform at least one action in response to determining that the first event corresponds to a critical security event, wherein the at least one action includes recording selected information associated with the critical security event in non-volatile memory, and transmitting, via a wireless communication protocol, selected information relating to the critical security event to a first remote system which is located external to the gaming device.

In at least one embodiment, the first security system and/or gaming device may be further operable to acquire selected information relating to the gaming device, the selected information including at least a portion of information selected from a group consisting of: historical game data, game state data, wager related data, gaming device state information, gaming device movement data, security information, fault-related information, gaming device ID information, timestamp information, and security system ID information.

In at least one embodiment, the first security system and/or gaming device may be further operable to transmit, in response to detection of a first security-related event or condition at the gaming device, selected information to the first remote system, wherein the selected information includes at least a portion of information selected from a group consisting of: historical game data, game state data, wager related data, gaming device state information, gaming device movement data, security information, fault-related information, gaming device ID information, timestamp information, and security system ID information.

In at least one embodiment, the first security system and/or gaming device may be further operable to take action, in response to detection of a first security-related event or condition at the gaming device, to preserve selected information relating to the gaming device, wherein the selected information includes at least a portion of information selected from a group consisting of: historical game data, game state data, wager related data, gaming device state information, gaming device movement data, security information, fault-related information, gaming device ID information, timestamp information, and security system ID information.

In at least one embodiment, the first security system and/or gaming device may be further operable to initiate, in response to detection of a first security-related event or condition at the gaming device, at least one first action for shutting down one or more components of the gaming device.

In at least one embodiment, the first security system and/or gaming device may be further operable to initiate, in response to detection of a first security-related event or condition at the gaming device, at least one first action for disabling game play at the gaming device.

In at least one embodiment, the least one security-related event and/or condition includes at least one condition or event selected from a group consisting of: detection a first event at the gaming device which meets or exceeds specified threshold criteria, detection a first condition at the gaming device which meets or exceeds specified threshold criteria, detection of an event or condition at the gaming device which may result in damage to the gaming device, detection of an event or condition at the gaming device which may result in loss or altering of information stored at the gaming device, detection of an unauthorized event or condition at the gaming device, detection of an event or condition at the gaming device which relates to an access of the interior area of the gaming device, detection of an event or condition at the gaming device which relates to access of cash stored at the gaming device, and detection of a fault-related event or condition at the gaming device.

Additional objects, features and advantages of the various aspects described or referenced herein will become apparent from the following description of its preferred embodiments, which description should be taken in conjunction with the accompanying drawings.

DESCRIPTION OF EXAMPLE EMBODIMENTS

Figure 1:
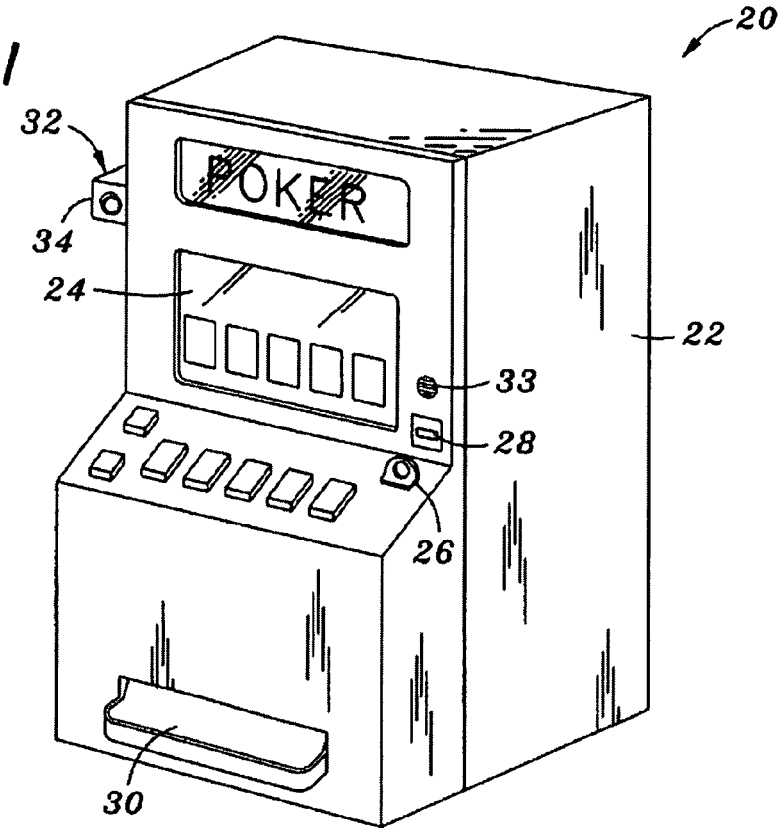
FIG. 1 shows an example embodiment of a gaming device 20 in accordance with a specific embodiment.

Various techniques will now be described in detail with reference to a few example embodiments thereof as illustrated in the accompanying drawings. In the following description, numerous specific details are set forth in order to provide a thorough understanding of one or more aspects and/or features described or reference herein. It will be apparent, however, to one skilled in the art, that one or more aspects and/or features described or reference herein may be practiced without some or all of these specific details. In other instances, well known process steps and/or structures have not been described in detail in order to not obscure some of the aspects and/or features described or reference herein.

One or more different inventions may be described in the present application. Further, for one or more of the invention(s) described herein, numerous embodiments may be described in this patent application, and are presented for illustrative purposes only. The described embodiments are not intended to be limiting in any sense. One or more of the invention(s) may be widely applicable to numerous embodiments, as is readily apparent from the disclosure. These embodiments are described in sufficient detail to enable those skilled in the art to practice one or more of the invention(s), and it is to be understood that other embodiments may be utilized and that structural, logical, software, electrical and other changes may be made without departing from the scope of the one or more of the invention(s). Accordingly, those skilled in the art will recognize that the one or more of the invention(s) may be practiced with various modifications and alterations. Particular features of one or more of the invention(s) may be described with reference to one or more particular embodiments or figures that form a part of the present disclosure, and in which are shown, by way of illustration, specific embodiments of one or more of the invention(s). It should be understood, however, that such features are not limited to usage in the one or more particular embodiments or figures with reference to which they are described. The present disclosure is neither a literal description of all embodiments of one or more of the invention(s) nor a listing of features of one or more of the invention(s) that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. To the contrary, a variety of optional components are described to illustrate the wide variety of possible embodiments of one or more of the invention(s).

Further, although process steps, method steps, algorithms or the like may be described in a sequential order, such processes, methods and algorithms may be configured to work in alternate orders. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred.

When a single device or article is described, it will be readily apparent that more than one device/article (whether or not they cooperate) may be used in place of a single device/article. Similarly, where more than one device or article is described (whether or not they cooperate), it will be readily apparent that a single device/article may be used in place of the more than one device or article.

The functionality and/or the features of a device may be alternatively embodied by one or more other devices that are not explicitly described as having such functionality/features. Thus, other embodiments of one or more of the invention(s) need not include the device itself.

One aspect disclosed herein relates to a gaming device which includes a security monitoring and reporting system (hereinafter "security monitoring/reporting system"). In at least one embodiment, the security monitoring/reporting system may be configured or designed to automatically monitor various conditions, events, and/or activities at the gaming device for various types of security-related issues, and to automatically and/or dynamically report the detection of security-related issues to one or more devices, systems and/or other entities.

In at least one embodiment, the term "gaming device" may be used to describe and variety of different types of machines, devices and/or systems which may be used or accessed by one or more users (e.g., players) for engaging in wager-based gaming activities. Examples of different types of gaming devices may include, but are not limited to, one or more of the following: mobile gaming devices, gaming machines, gaming tables, slot machines, server-based gaming systems, etc.

In at least one embodiment, the security monitoring/reporting system may be implemented as an independent, self-supporting unit or device which may be installed at the gaming device. In at least one embodiment, the security monitoring/reporting system, when installed at the gaming device may be analogized to that of a Black Box system which is installed at an airplane. For example, in at least one embodiment, the security monitoring/reporting system may be configured or designed to include its own processor, portable power source, wireless communication interfaces, and memory, and may be further configured or designed to be able to continue to perform its programmed functions and/or operations even after the occurrence of a partial or complete failure of the gaming device (and/or the occurrence of a partial or complete failure of one or more the gaming device's associated components/devices).

For example, in at least one embodiment, the security monitoring/reporting system may be implemented as a small footprint electrical/mechanical device which includes a low power CPU, battery, serial/USB interface, non-volatile memory, wireless transceiver, and sensor(s). In one embodiment, the security monitoring/reporting system (SMRS) may be attached inside a gaming enclosure, and one or more of its sensors may be configured or designed to monitor one or more locations of the access door and/or enclosure edges. In at least one embodiment, communication transports of the security monitoring/reporting system may be connected to a gaming network via one or more wireless interfaces. For example, in one embodiment, the security monitoring/reporting system may be configured to communicate wirelessly with a security management system.

In one embodiment, the gaming device includes a housing and may be arranged to present at least one wager-based game for play by a player. One or more security monitoring devices may be installed at the gaming device and supported by the housing. Examples of various types of security monitoring devices may include, but are not limited to, one or more of the following (or combinations thereof):

- cameras;
- microphones;
- optical sensors;
- motion sensors;
- acoustic sensors;
- pressure sensors;
- light sensors;
- thermal sensors;
- distance sensors;
- electrical/audio frequency/pulse sensing/analysis components;
- g-force (x/y/z dimensions) sensing/analysis components;
- location tracking components (e.g., GPS components);
- etc.

In at least one embodiment, at least one security monitoring device may be arranged to collect image information regarding activities occurring at or associated with the exterior of the gaming device. These images may comprise images of a player playing the gaming device and images of use of gaming device buttons, coin and bill acceptors and the like.

In some embodiments, at least one security monitoring device may be arranged to collect various types of security-related information regarding activities associated with an interior of the gaming device. Examples of various types of security-related information may include, but are not limited to, one or more of the following (or combinations thereof):

- Images of various regions of the interior of the gaming device, which, for example, may be taken at different time intervals.
- Images of persons accessing the interior of the gaming device via a door.
- Images of one or more devices and/or compartments inside the gaming device.
- Information relating to access door opening/closing events/conditions.
- Information relating to enclosure opening/closing events/conditions.
- Information relating to gaming device tampering events/conditions.
- Information relating to gaming device fault detection events/conditions.
- Information relating to events events/conditions detected by one or more security sensors.
- Timestamp information associated with one or more security-related events/conditions.
- Etc.

In one embodiment, a controller is provided for controlling one or more security-related information collection devices and the information collected or generated thereby. In one embodiment, the controller may comprise a master gaming device controller which also controls various other devices of the gaming device and facilitates the presentation of the game. The gaming device also includes at least one information storage device. In one embodiment, the gaming device controller may cause collected security-related information to be stored at the information storage device.

According to different embodiments, at least a portion of the security-related information may be automatically and/or dynamically generated and/or recorded. According to specific embodiments, portions of the security-related information may be generated and/or recorded on a continuous basis (e.g., in real-time), on a periodic basis, and/or on an event/condition driven basis. To limit the total information which is stored, the information stored at the information storage device may be overwritten after a period of time or after a predetermined amount of data or information is stored. In another embodiment, the controller may be arranged to cause security-related information to be stored and not overwritten (e.g., upon the detected occurrence of one or more specified events/conditions). For example, in one embodiment, when a particular event occurs, security-related information for a period of time before, during and after the event is stored. The information is not overwritten until an override instruction is provided.

In one embodiment, the gaming device and/or security monitoring/reporting system may be linked with a security management system by at least one communication or data link. In one embodiment, a wireless communication link may be provided over which streaming image and/or audio data or information may be transmitted from the security monitoring/reporting system to the security management system. Control information may also be transmitted over the same or a similar type link. In another embodiment, the collected security-related information may comprise data in digital form or comprise an analog signal converted to digital form and then transmitted over a digital link.

In at least one embodiment, the security management system may include at least one display. Security-related information may be transmitted to the security management system for viewing and/or storage. In one embodiment, a user of the security management system may cause the controller to transmit the image and/or audio information as it is collected for "real time" viewing or play. In another embodiment, the security-related information or information may automatically be sent to the security management system when one of the predetermined events occurs. In one embodiment, the analog output of several sensors may be modulated and transmitted. In another embodiment, multiple digital data streams or a single data stream of packetized digital data may be transmitted.

In one embodiment, the controller may be associated with a peripheral device of the gaming device, such as a player tracking device or bill validation device. The peripheral device may be associated with the network or communication link. In one embodiment, the security monitoring/reporting system may be configured or designed to transmit data via this link. In other arrangements, the security monitoring/reporting system may be connected to an associated device, and the communication link may be shared with the associated device or be independent of a link (if any) to which the peripheral or other associated device is connected. In yet other embodiments, the security monitoring/reporting system may include its own dedicated hardware/software for allowing the security monitoring/reporting system to be operable to perform all (or selected portions) of its operations or tasks independently from the gaming device and/or associated peripheral devices.

According to specific embodiments, the security monitoring/reporting system may be configured or designed to provide a variety of different features and functions. For example, in some embodiments, the security monitoring/reporting system may include one or more cameras operable to zoom, pan, filter, etc. Additionally, security-related information may be compressed or converted to reduce the amount of data which is stored and/or transmitted. In at least one embodiment, various sensors and/or other components of the security monitoring/reporting system may be controlled remotely, such as, for example, by a remote user, by the security management system, by an authorized mobile or handheld device, etc.

According to specific embodiments, the security monitoring/reporting system may be configured or designed to provide a variety of different control features. For example, in at least one embodiment, the various sensors and/or other components associated with the security monitoring/reporting system may be activated upon the occurrence of certain conditions and/or events which meet or exceed predetermined or predefined criteria (such as, for example, predefined minimum threshold criteria). Examples of such conditions and/or events may include, but are not limited to, one or more of the following (or combinations thereof):

- detection of an opening or closing of an access door at the gaming device;
- detection of specific movements or loud noises (e.g., which meet or exceed predetermined criteria);
- detection of tampering activity at the gaming device;
- detection of unauthorized activity at the gaming device;
- detection of the use of non-authorized and/or non-authenticated components at the gaming device;
- detection of improper or invalid input activity at the gaming device, such as, for example, use of a stolen player card, input of counterfeit currency, etc.;
- detection of a fault event or condition at one or more components of the gaming device;
- etc.

In at least one embodiment, when the security monitoring/reporting system detects an occurrence of a potential security-related event or condition, it may automatically and dynamically generate and transmit a security notification alert message to the security management system (and/or other devices/systems of the gaming network). In at least one embodiment, the security notification alert message may be transmitted via a wireless communication protocol, and may include various types of information relating to the potential security-related event or condition.

Additionally, according to at least one embodiment, when the security monitoring/reporting system detects an occurrence of a potential security-related event or condition, the security monitoring/reporting system may respond by initiating one or more appropriate actions such as, for example one or more of the following (or combinations thereof):

- Recording details relating to the detected event/condition.
- Taking appropriate action to prevent damage to one or more components or systems of the gaming device (such as, for example, suspending or shutting down one or more systems or components, etc.).
- Taking appropriate action to preserve selected data generated and/or stored at the gaming device such as, for example, historical game data, critical information, game state data, wager related data, and/or other data or information which may be desired and/or used for reconstructing conditions and/or events at the gaming device before, during and/or after the detected event or condition.
- Taking appropriate action to identify and transmit selected information (such as, for example, historical game data, critical information, game state data, wager related data, image data, audio data, and/or other desired information) to an external system.

In at least one embodiment, the security monitoring/reporting system may be operable to acquire and/or generate security-related information and/or other information regarding activities associated with a gaming device. Such information is useful for a variety of security purposes such as, for example:

- ascertaining and identity of a player or other person at (or adjacent to) the gaming device;
- detecting attempts to tamper with the gaming device;
- detecting attempts to take coins or cash from the inside;
- detecting attempts to tamper with internal mechanisms of the gaming device;
- etc.

In at least one embodiment, the security-related information may include information regarding activities directly associated with the gaming device, as well as activities indirectly associated with the gaming device such as, for example, persons and/or devices in the vicinity of the gaming device, patron traffic information during various times of day, activities at other gaming devices (such as those which are adjacent to or located proximate to the gaming device).

In one or more embodiments, image information captured by the security monitoring/reporting system may be used for verification and/or identification purposes. For example, in one embodiment, a player's image may be captured and transmitted for verification when a player attempts to utilize a player reward card at a gaming device. In one embodiment, the image of a person who is issued a player card, smart card or the like may be stored on the card, and the card may only be used if the image of the person attempting to use the card as collected at the gaming device matches the image stored on the card. As another example, in at least one embodiment, when the security monitoring/reporting system detects an occurrence of a human-related tampering event at the gaming device, the security monitoring/reporting system may capture one or more images of the person(s) at or near the gaming device for identification purposes. In some embodiments, the security monitoring/reporting system may also capture images of a person's body parts (e.g., hands, fingers, etc.). For example, in one embodiment, when the security monitoring/reporting system detects an access door open event at the gaming device, the security monitoring/reporting system may capture one or more images of the interior cavity of the gaming device. In at least one embodiment, the captured images may include images of a person's body parts and related objects (e.g., hands, fingers, rings, watches, bracelets, clothing, etc.) which have been placed into the interior cavity of the gaming device.

FIG. 1 shows an example embodiment of a gaming device 20 in accordance with a specific embodiment. In at least one embodiment, the gaming device 20 may be adapted to present at least one wager-based game for play to a player. As illustrated, the gaming device 20 includes a housing 22 which supports and/or houses the various components of the gaming device 20. In the embodiment illustrated, the gaming device 20 is adapted to present a game of video poker and includes a display 24 for displaying images of cards and other information. A variety of buttons may be provided by which a player may provide input, such as an instruction to deal cards, hold cards, place bets and cash out.

In one or more embodiments, the gaming device 20 is adapted to present a wager-type game. In this arrangement, a player may be required to place a bet or wager in order to participate in the game. In the event the outcome of the game is a winning outcome, then the player may be provided with an award. In one arrangement, the award may be winnings based upon the amount wagered or bet by the player.

In order to accept a wager, the gaming device 20 may include a coin acceptor 26 for accepting coins. The gaming device 20 may also include a bill acceptor or validator 28 for accepting paper currency. The gaming device 20 may be provided with other means for accepting or verifying wager values and/or indicia of credit, such as, for example, a credit card reader, a ticket reader (e.g., for accepting credit-based tickets or vouchers), a wager token (e.g., gaming chip) acceptor, etc. In at least one embodiment, the gaming device may include a mechanism for enabling a player to place wagers at the gaming device using funds and/or credits which are linked to a remote-based financial account associated with that player.

In the example of FIG. 1, a player may be awarded a prize or payout if the outcome of the card hand is a predetermined combination of cards. In one embodiment, the award may be paid in coins, such as to a coin tray 30. In other embodiments, the award may be paid as a ticket, credit or the like.

It should be understood that the gaming device 20 may be adapted to present one or more of a wide variety of games. Depending upon the game presented, the configuration of the machine may vary. For example, in the event the gaming device 20 is adapted to present the game of slots, then the gaming device 20 may include a plurality of spinning reels.

As used herein, the term gaming device is not limited to a machine such as that just described and illustrated in FIG. 1. For example, the principles described or referenced herein may be applied to a wide variety of devices or systems which are adapted to present one or more games. Such devices include personal computing devices, whether of the desktop, notebook, handheld or other varieties, which devices are arranged to implement a game. Other devices may be specially configured to present one or more games, but be other than as configured above. Other devices may include gaming terminals or interfaces located in a wide variety of locations, whether custom configured or having a more general applicability. For example, the device may comprise a gaming terminal which is located in a hotel room, or which is deployed at a physical location outside of the casino establishment. As noted, the device may also comprise a personal computing device located in a player's home, which, for example, may be connected to the casino gaming network via the internet.

In an example embodiment, the gaming device 20 comprises a security monitoring/reporting system which includes the security monitoring/reporting system. In one embodiment, this system includes at least one security monitoring device associated with the gaming device 20 for obtaining image information regarding events and/or conditions occurring at or associated with the gaming device.

According to different embodiments, the security monitoring/reporting system may comprise a variety of types of devices. In one embodiment, the security monitoring/reporting system comprises a camera 32. The camera 32 may comprise a CCD or CMOS type security monitoring/reporting system. In one embodiment, the camera 32 provides an output signal representative of image information collected through a lens thereof. This output signal may comprise an analog or digital signal. The security monitoring/reporting system may be arranged to generate single frame or multi-frame (moving image) data or video, may include optical and/or digital zoom, light compensation and other features, and generate black and white or color image information. The security monitoring/reporting system may be arranged to generate infrared image information. Other features of the camera may include auto focus, macro focus, use of differing types of lenses (such as wide angle or telephoto), interchangeability of lenses, and use of filters such as polarizing filters and color filters, among others.

The camera 32 may be mounted to or supported by the gaming device 20. As illustrated, in one embodiment the camera 32 has a body 34 which is mounted to the exterior of the housing 22 of the gaming device 20. Of course, the camera 32 may be mounted to the gaming device 20 in a wide variety of manners. For example, the camera 32 may be mounted within a portion of the housing 22 of the gaming device 20. The camera 32 may be located behind display glass or the like so as not to be visible to a player of the gaming device 20. For example, the camera 32 may be located behind security glass located in a top box mounted upon or set upon the top of the gaming device 20. The camera 32 may also be mounted on a stand or other support which is connected to the gaming device 20.

The camera 32 may be positioned in a number of locations. In one embodiment, the camera 32 is positioned to obtain image information regarding a player of the gaming device 20 and activities of that player while interacting with the gaming device 20. As illustrated, the camera 32 is directed outwardly (i.e. the lens or other light gathering element is directed towards) of the gaming device 20 in the direction of a front of the machine and the area where a player normally sits or stands while using the gaming device 20. In addition, the camera 32 is directed downwardly to encompass the area of the buttons, coin acceptor 26, and bill validator 28.

It will be appreciated that depending on the size of the gaming device 20 and the nature of the camera, more than one camera may be necessary to obtain image information from all of the desired areas. For example, depending upon the focal length of a lens of the camera (for example 20 mm vs. 35 mm), the area focused on the imaging surface may be smaller than the desired area of coverage. The configuration of the gaming device 20 may also dictate the use of more than one camera. For example, the location of buttons or other input devices may be hidden from the view of another camera directed at the area of the player.

In one or more embodiments, the camera 32 may be moveable, whereby the various areas of image collection may be changed. For example, the camera 32 may be mounted in a manner permitting it to rotate from side to side, pivot up and down, and/or travel laterally or vertically.

As also indicated above, in another embodiment, the camera 32 may be provided with a zoom feature for changing the areas of focus. In one or more embodiments, the zoom may comprise an optical zoom or a digital zoom. These features of the camera 32 may be controlled remotely, such as via a control unit as described in more detail below.

In one or more embodiments, the camera 32 may employ a wide angle lens. This arrangement permits collection of image data over a wide angle, but in some instances may cause the collected image to be distorted. Software or hardware, such as associated with a camera (video) controller or with a main gaming device controller or other device may be used to perform image enhancement. Software may also be provided which define minimum levels of motion detection, whereby collected image data may not be saved or transmitted unless a level of activity above the minimum level is detected. This arrangement aids in reducing the amount of data transmitted and stored, saving bandwidth and memory.

In other embodiments, the security monitoring/reporting system may include other types of sensors which are deployed at the exterior of the gaming device. For example, in at least one embodiment, one or more sensors may be configured or designed to continuously or periodically monitor conditions relating to various regions and/or features of the gaming device. Examples of such regions and/or features may include, but are not limited to, one or more of the following (or combinations thereof):

- metering windows (e.g., window regions disposed in the gaming device housing for providing visibility of hard meters and/or other components located at the interior of the gaming device housing;
- access doors and/or other interfaces (e.g., seams, hinges, openings, etc.) which may be used for gaining access to the interior of the gaming device;
- electrical interfaces (such as, for example, power supply interfaces, wired data communication interfaces, etc.);
- key slots, locks, and/or other locking mechanisms;
- bill validator input slot(s);
- etc.

In one or more embodiments, the security monitoring/reporting system may include an audio collection device. Referring to FIG. 1, in one embodiment, the audio collection device comprises a microphone 33. The microphone 33 may be of a variety of types, including the well-known electromechanical diaphragm type. In one embodiment, a single element which is capable of use both as a speaker for generating audible information and a microphone for collecting audible information, may be utilized.

The microphone 33 may be associated with the gaming device 20 and arranged to collect audio information generated about or traveling to the vicinity of the machine. In an example embodiment, at least one microphone 33 may be arranged to collect audio information associated with the front exterior portion of the gaming device 20, such as a person's voice. Of course, there may be a plurality of audio collection devices associated with the gaming device 20 and such devices may be located in a variety of positions. In one embodiment, the microphone 33 or other audio collection device is generally hidden from view by a player.

Figure 2A:
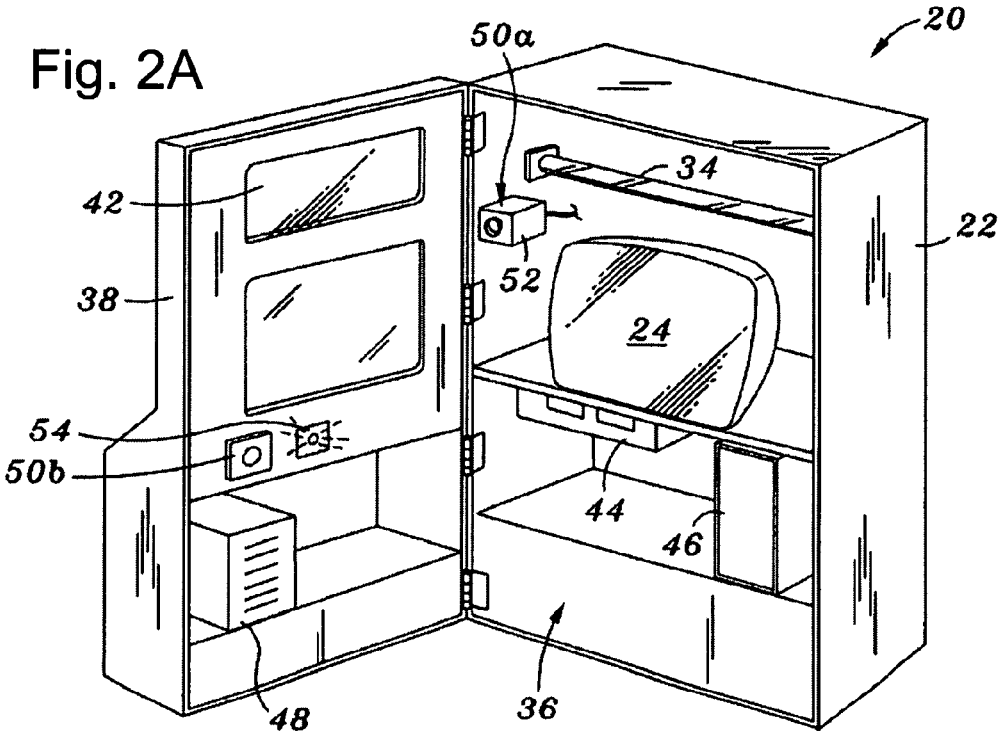
FIG. 2A shows an example embodiment of an interior region 36 of the gaming device 20 of FIG. 1.

FIG. 2A shows an example embodiment of an interior region 36 of the gaming device 20 of FIG. 1. As illustrated, the gaming device housing 22 includes a door 38 moveable between open and closed positions for selectively accessing the interior 36. FIG. 2A illustrates the door 38 in an open position, whereby access to the interior 36 is permitted. FIG. 1 illustrates the gaming device 20 with the door 38 in a closed position. In the embodiment illustrated, the door 38 is mounted to a main portion of the housing 22 with one or more hinges.

Referring to FIG. 2A, gaming device may include a variety of different types of equipment and/or components housed within the interior 36. As illustrated, a display 24 is mounted for alignment with a port in the door 38 for viewing by a player. A light 34 is provided for backlighting gaming device glass 42 located in an upper portion of the door 38. A gaming device controller 44 is provided which controls the various components/devices of the gaming device 20, as is well known. A bill or cash box 46 is provided for housing currency, such as paper bills or tickets, accepted by the gaming device 20 through the bill validator 28. A coin hopper or box 48 is provided for housing coins which are accepted through the coin acceptor 26 and from which coins may be dispensed to the coin tray 30 as winnings.

In an example embodiment, the security monitoring/reporting system may be arranged to generate, capture and/or otherwise obtain security-related information regarding activities in or at the area of the interior 36 of the gaming device 20. In at least one embodiment, the security monitoring/reporting system may include a variety of different sensors (and/or other devices/components) which have been deployed at various locations of the interior 36, and which have been configured or designed to continuously or periodically monitor conditions relating to various regions, features and/or components located within the gaming device interior.

For example, as illustrated in the example embodiment of FIG. 2A, two "interior" cameras 50*a, b* may be provided. As with the exterior camera(s) 32, the number, location and type of interior cameras 50*a, b* may vary. In one or more embodiments, a first interior camera 50*a* may be arranged to obtain image information regarding events associated with the door 38 and the area around the door. As such, the first interior camera 50*a* is mounted to the main portion of the housing 22 and is directed outwardly towards the door 38. As illustrated, the first interior camera 50*a* has a body 52 which is mounted to an interior of the housing 22. In one or more embodiments, a second interior camera 50*b* may be arranged to obtain image information regarding events associated with the main portion of the housing. As such, the second interior camera 50*b* is mounted to the door 38 and is directed outwardly towards the main portion of the housing 22. In the embodiment illustrated, the second interior camera 50*b* is mounted within a portion of the door 38.

In other embodiments, the security monitoring/reporting system may include other types of sensors which are deployed at the gaming device interior 36. For example, in at least one embodiment, one or more sensors may be configured or designed to continuously or periodically monitor conditions relating to various regions, features and/or components located within the gaming device interior. Examples of such regions and/or features may include, but are not limited to, one or more of the following (or combinations thereof):

- metering components;
- access doors and/or other interfaces (e.g., seams, hinges, openings, etc.) which may be used for gaining access to the interior of the gaming device;

electrical interfaces (such as, for example, power supply interfaces, wired data communication interfaces, etc.);
key slots, locks, and/or other locking mechanisms;
cash box(es);
bill validator devices;
memory components;
system bus(es);
etc.

In an example embodiment, one or more lights 54 may be provided for illuminating areas of the gaming device interior where image security-related information is to be gathered. For example, the light 54 may be associated with the door 38 and project light towards the interior portion of the housing 22. Other means for lighting the desired areas may be provided, including use of flashes. In one or more embodiments, infrared sensors or cameras may be used in low light locations. In one embodiment, the light 54 or other means of illumination may be activated only when the camera(s) 50*a,b* are activated.

In one example embodiment, cameras 32, 50*a,b* may be arranged to obtain image information or data. In one embodiment, at least one camera 32, 50*a*, 50*b* may be arranged to provide moving image information or data. In other embodiments, one or more of the cameras 32, 50*a,b* may be arranged to provide still image (i.e. single "frame") data. In an example embodiment, the output of each camera 32, 50*a,b* is a digital signal representative of the image(s). Additionally, in at least one embodiment, one or more audio collection devices may be arranged at the gaming device interior to collect audio information associated with the interior portion of the gaming device.

In at least one embodiment, the security monitoring/reporting system may include a reflective sensor deployed at the gaming device interior. In at least one embodiment, the reflective sensor may be configured or designed to monitor one or more locations of the access door and/or enclosure edges, and to detect security-related events such as, for example, access door opening/closing events, enclosure opening/closing events, tampering events, intrusive/alien object(s), etc.

Figure 2B:
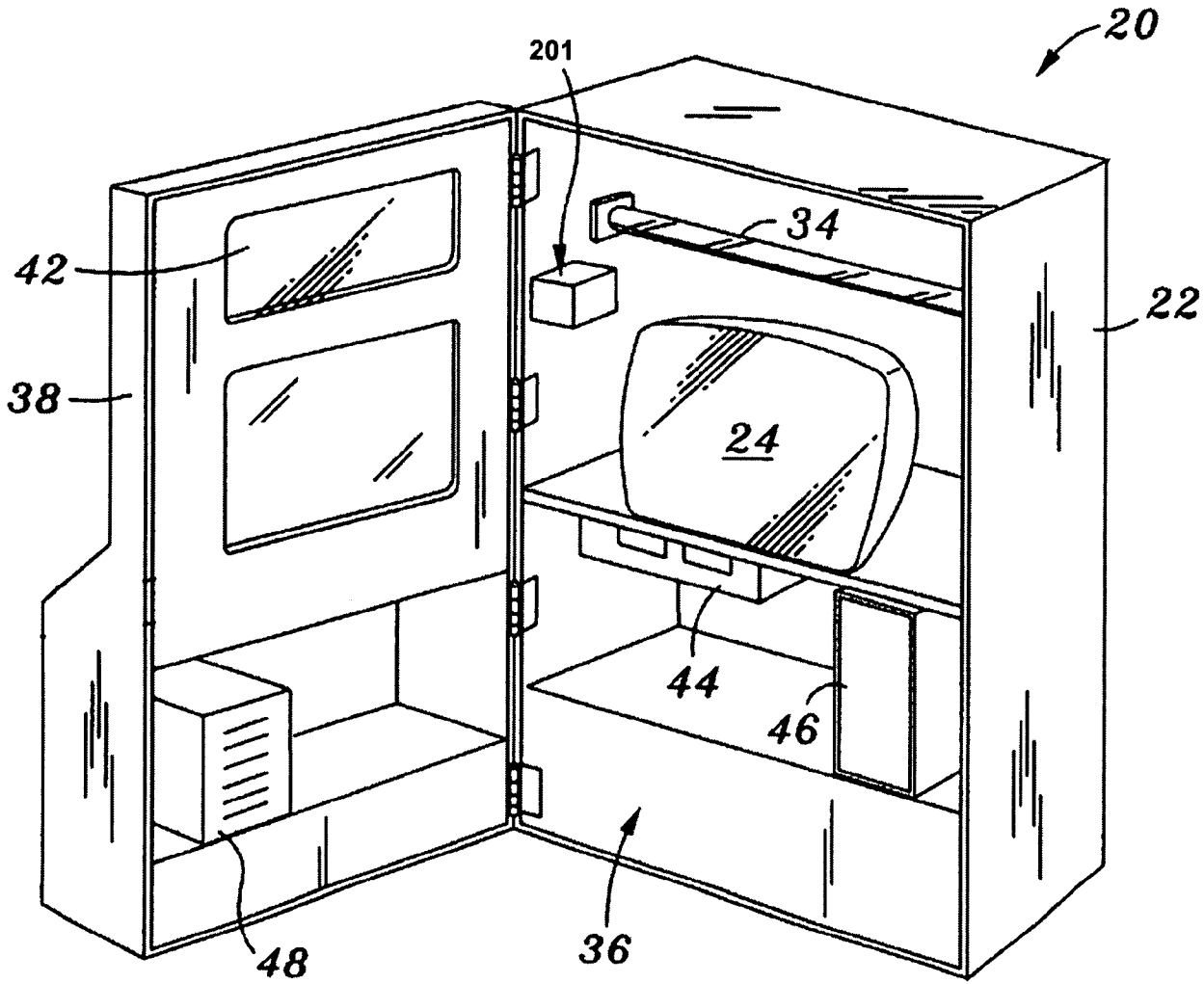
FIG. 2B shows an alternate example embodiment of an interior region 36 of a gaming device.

FIG. 2B shows an alternate example embodiment of an interior region 36 of a gaming device. As illustrated, the gaming device housing 22 includes a door 38 moveable between open and closed positions for selectively accessing the interior 36. FIG. 2B illustrates the door 38 in an open position, whereby access to the interior 36 is permitted. In the embodiment illustrated, the door 38 is mounted to a main portion of the housing 22 with one or more hinges.

In the example embodiment of FIG. 2B, gaming device 20 includes a security monitoring/reporting system 201 which, for example, may be installed within interior 36 of the gaming device. In this particular embodiment, the security monitoring/reporting system 201 may be implemented as a modular, self-contained unit or device having a small footprint, which may be configured or designed to be mounted or installed within interior 36 of the gaming device.

In at least one embodiment, the security monitoring/reporting system 201 may include a housing, low power CPU, battery, serial/USB interface(s), non-volatile memory, wireless transceiver, and sensor(s). In one embodiment, the security monitoring/reporting system may be installed inside a gaming enclosure, and one or more of its sensors may be configured or designed to monitor one or more locations of the access door and/or enclosure edges. In at least one embodiment, the security monitoring/reporting system 201 may include wired and/or wireless interfaces for communicating with external devices, components, and/or systems. For example, in one embodiment, the security monitoring/reporting system may include at least one wired interface for communicating with various components of the host gaming device. Additionally, the security monitoring/reporting system may include at least one wireless interface for communicating with other devices/systems of the gaming network.

It will be appreciated that the modular, small footprint design of the security monitoring/reporting system 201 may provide a number of benefits and advantages. Various examples of a least some of the benefits and/or advantages of security monitoring/reporting system 201 may include, but are not limited to, one or more of the following (or combinations thereof):

The modular, self-contained, small footprint design of the security monitoring/reporting unit 201 allows the unit to be easily and quickly installed in new and/or existing gaming devices.

In some embodiments, additional security-related functionality may be provided to a gaming device (e.g., via installation and use of a security monitoring/reporting system) without requiring modification of the gaming device's existing hardware and/or software components.

In other embodiments, an existing gaming device may be easily retrofitted to include a security monitoring/reporting system (e.g., to thereby provide additional security-related functionality to the gaming device) with only minor modifications to the gaming device's existing hardware and/or software components.

The security monitoring/reporting system provides a low-cost solution for enabling a gaming device to be provided with additional security-related functionality, and avoids expensive retrofitting and/or redesigning of the gaming machine.

Various embodiments of security monitoring/reporting systems may be implemented using a standardized or generic design which can be integrated into a majority of conventional gaming systems/devices.

The modular design of at least some embodiments of the security monitoring/reporting units allows such units to be manufactured more quickly for rapid market deployment.

In some embodiments, multiple security monitoring/reporting systems may be automatically and quickly configured at relatively high speed.

In some embodiments, the security monitoring/reporting system may be configured or designed to utilize a low power mode of operation for enabling the system to run on battery power for many years.

Etc.

Figure 3:
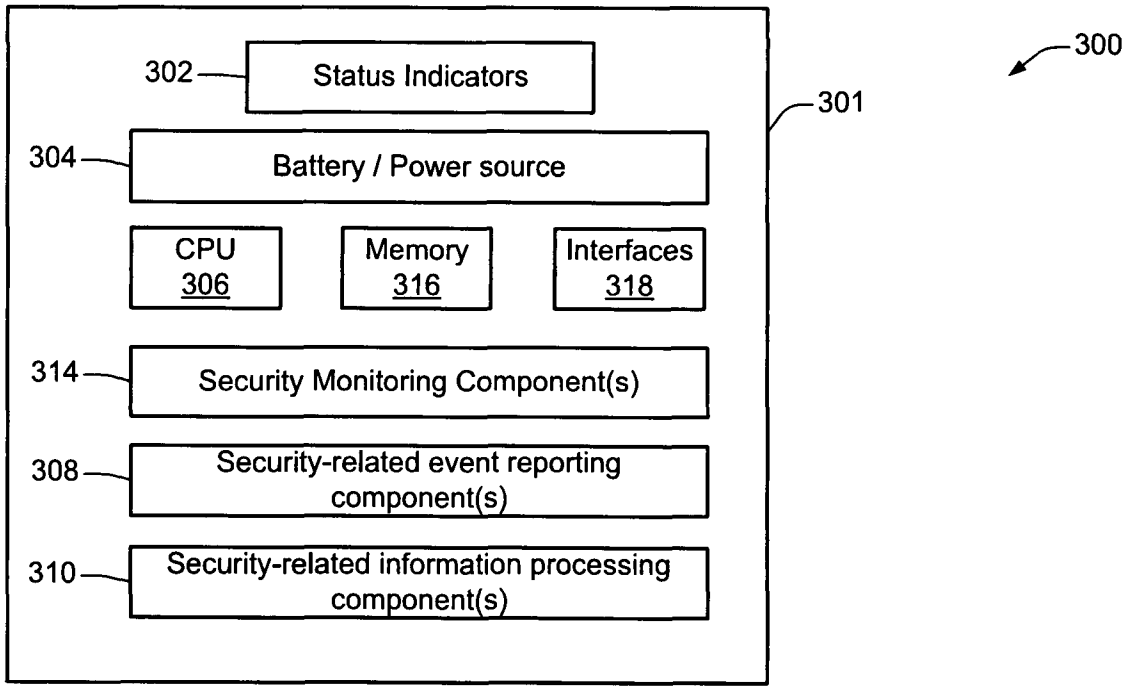
FIG. 3 shows a simplified block diagram of various components which may be used for implementing a security monitoring/reporting system 300 in accordance with a specific embodiment.

FIG. 3 shows a simplified block diagram of various components which may be used for implementing a security monitoring/reporting system 300 in accordance with a specific embodiment.

In at least one embodiment, the security monitoring/reporting system may be implemented as an independent, self-supporting unit or device which may be installed at a gaming device. In at least one embodiment, the security monitoring/reporting system, when installed at the gaming device may be analogized to that of a Black Box system which is installed at an airplane. For example, in at least one embodiment, the security monitoring/reporting system may be configured or designed to include its own processor, portable power source, wireless communication interfaces, and memory, and may be further configured or designed to be able to continue to perform its programmed functions and/or operations even during times when the gaming device is in a powered off state and/or even after the occurrence of a partial or complete failure of the gaming device (and/or the occurrence of a partial or complete failure of one or more the gaming device's associated components/devices).

As illustrated in the example of FIG. 3, security monitoring/reporting system 300 may include a variety of components, modules and/or systems for providing functionality relating to one or more aspects described herein. Other security monitoring/reporting system embodiments (not shown) may include different or other components than those illustrated in FIG. 3. For example, security monitoring/reporting system 300 may include, but not limited to, one or more of the following (or combination thereof):

A housing or enclosure 301.

At least one processor or CPU (306). In at least one implementation, the processor(s) 306 may be operable to implement features and/or functionality similar to other processors described or referenced herein.

Memory 316, which, for example, may include volatile memory (e.g., RAM), non-volatile memory (e.g., NV-RAM, disk memory, FLASH memory, EPROMs, etc.), unalterable memory, and/or other types of memory. In at least one implementation, the memory 316 may be operable to implement features and/or functionality similar to other memory described or referenced herein.

Interface(s) 318 which, for example, may include wired interfaces and/or wireless interfaces. In at least one implementation, the interface(s) 318 may be operable to implement features and/or functionality similar to other interfaces described herein. For example, in at least one embodiment, interface(s) 318 may include one or more interfaces for communicating with other systems, processes, components and/or devices of the gaming device. in at least one embodiment, interface(s) 318 may include one or more one or more wireless communication interfaces, which, for example, may be configured or designed to communicate with components of the gaming device and/or with other external devices and/or systems such as, for example, one or more of the following (or combinations thereof): remote servers, security management system(s), electronic gaming machines, wireless devices (e.g., PDAs, other gaming devices, cell phones, player tracking transponders, etc.), base stations, etc. According to different embodiments, such wireless communication may be implemented using one or more wireless interfaces/protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetics, etc.

At least one power source 304. In at least one implementation, the power source may include at least one mobile power source for allowing the security monitoring/reporting system to operate in a mobile environment. For example, in one implementation, the battery 304 may be implemented using a rechargeable type battery. Additionally, in at least one embodiment, security monitoring/reporting system 300 may include a battery recharging system which, for example, may be configured or designed to recharge the gaming device's rechargeable battery. In one embodiment, the battery recharging system may be configured or designed to utilize power from an external power source (such as, for example, power from the gaming device's battery, power from other AC and/or DC power sources, etc.) for recharging the security monitoring/reporting system's power source 304.

One or more display(s) (if desired). According to various embodiments, such display(s) may be implemented using, for example, LCD display technology, OLED display technology, and/or other types of conventional display technology. In at least one implementation, display(s) 308 may be adapted to be flexible or bendable. Additionally, in at least one embodiment the information displayed on display(s) 308 may utilize e-ink technology (such as that available from E Ink Corporation, Cambridge, Mass., www.eink.com), or other suitable technology for reducing the power consumption of information displayed on the display(s) 308. In some embodiments, it may be desirable to not include a display at the security monitoring/reporting system.

One or more user I/O Device(s) such as, for example, touch keys/buttons, DIP switches, scroll wheels, cursors, touchscreen sensors, etc.

One or more status indicators 302. For example, in one implementation, one or more colored status indicators (such as, for example, LEDs) may be included on one or more regions of the security monitoring/reporting system, and adapted to provide various information such as, for example: communication status; security monitoring/reporting system health status; security monitoring/reporting system operating mode or state; battery power status; battery charging status; error detection status; etc.

Security monitoring component(s) 314. In at least one embodiment, security monitoring component(s) 314 may include one or more different types of sensors for monitoring and detecting various types of security-related activities, events and/or conditions associated with a given gaming device.

Security-related information processing component(s) 310. In at least one embodiment, the security-related information processing component(s) may be configured or designed to analyze security-related information generated, captured and/or otherwise acquired by one or more security monitoring components, and may be further configured or designed to evaluate a detected event and/or condition at the gaming device with respect to predetermined criteria in order to determine whether the detected event and/or condition qualifies as a security-related event/condition.

Security-related event reporting component(s) 308. In at least one embodiment, the security-related event reporting component(s) 308 may be configured or designed to manage tracking and/or recording various security-related information associated with the gaming device. In at least one embodiment, security-related event reporting component(s) 308 may also be operable to track and/or record historical information relating to events and/or conditions which have occurred at the gaming device such as, for example, the number of times the access door has been opened (e.g., during one or more specified time intervals), the number of times the cash box has been accessed, etc.

etc.

In at least one embodiment, security monitoring component(s) 314 may include various types sensors and/or other components such as, for example, one or more of the following (or combinations thereof):

camera(s);
microphone(s);
optical sensor(s);
motion sensor(s);
acoustic sensor(s);
pressure sensor(s);

light sensor(s);
thermal sensor(s);
motion sensor(s);
etc.

In at least one embodiment, when the security monitoring/reporting system detects an occurrence of a security-related event or condition, it may automatically and dynamically generate and transmit a security notification alert message to the security management system (and/or other devices/systems of the gaming network). In at least one embodiment, the security notification alert message may be transmitted via a wireless communication protocol, and may include various types of information relating to the potential security-related event or condition.

Additionally, according to at least one embodiment, when the security monitoring/reporting system detects an occurrence of a security-related event or condition, the security monitoring/reporting system may respond by initiating one or more appropriate actions such as, for example one or more of the following (or combinations thereof):

Recording details relating to the detected event/condition.
Taking appropriate action to prevent damage to one or more components or systems of the gaming device (such as, for example, suspending or shutting down one or more systems or components, etc.).
Taking appropriate action to preserve selected data generated and/or stored at the gaming device such as, for example, historical game data, critical information, game state data, wager related data, power status data, sensor fault data, G-force sensor data, and/or other data or information which may be desired and/or used for reconstructing conditions and/or events at the gaming device before, during and/or after the detected event or condition.
Taking appropriate action to identify and transmit selected information (such as, for example, historical game data, critical information, game state data, wager related data, image data, audio data, and/or other desired information) to an external system.

In at least one embodiment, the security monitoring/reporting system may be operable to acquire, capture, and/or generate security-related information and/or other information regarding activities associated with a gaming device. Such information is useful for a variety of security purposes such as, for example:

ascertaining and identity of a player or other person at (or adjacent to) the gaming device;
detecting attempts to tamper with the gaming device;
detecting attempts to take coins or cash from the inside;
detecting attempts to tamper with internal mechanisms of the gaming device;
etc.

In at least one embodiment, the security monitoring/reporting system may be configured or designed to store various types of security-related information and/or other information in local memory (e.g., memory 316).

In some embodiments, the gaming device (and/or security monitoring/reporting system) may be configured or designed to periodically transmit selected information (such as, for example, movement information, gaming-related information, wager-related information, etc.) to an external or remote device/system, whereupon the information may then be preserved (e.g., stored in remote memory) and/or used for subsequent analysis, if desired.

In some embodiments, the gaming device (and/or security monitoring/reporting system) may be configured or designed to transmit a continuous stream of desired information (e.g., information relating to real-time conditions/events/states associated with the gaming device) to an external or remote device/system, whereupon the information may then be preserved (e.g., stored in remote memory) and used for subsequent analysis, if desired.

In at least one embodiment, if the security monitoring/reporting system is unable to establish connectivity with the security management system (and/or other desired devices/systems) the security monitoring/reporting system may temporarily store security-related information and/or other information in local memory. Thereafter, when the security monitoring/reporting system is subsequently able to establish connectivity with the security management system (and/or other desired devices/systems), it may then transmit all or selected portions of the stored information to the intended recipient system(s)/devices.

In at least one embodiment, security-related information which was recorded during one or more time intervals may be subsequently analyzed and/or reconstructed (e.g., using forensic analysis techniques) in order to assess whether or not the unit had been tampered with. In at least one embodiment, at least a portion of such recorded data may be obtained from data stored in the memory of the security monitoring/reporting system associated with that gaming device.

In at least one embodiment, such as, for example, where the gaming device is implemented as a portable gaming device, the security monitoring/reporting system may include one or more motion detection sensors such as, for example, MEMS (Micro Electro Mechanical System) accelerometers, that can detect the acceleration and/or other movements of the security monitoring/reporting system and/or gaming device. Examples of suitable MEMS accelerometers may include, but are not limited to, one or more of the following (or combination thereof): Si-Flex™ SF1500L Low-Noise Analog 3g Accelerometer (available from Colibrys, Inc., Stafford, Tex.); MXC6202 Dual Axis Accelerometer (available from MEMSIC, Inc. 800, North Andover, Mass.); ADXL330 iMEMS Accelerometer (available from Analog Devices, Norwood, Mass.); etc.

In at least some embodiments, other types of motion detection components may be used such as, for example, inertial sensors, MEMS gyros, and/or other motion detection components described herein. For example, MEMS accelerometers may be particularly suited for applications involving relatively large degrees of vibration, impact, and/or fast motion. MEMS gyros are great for may be particularly suited for applications involving orientation sensing and/or slow movements.

In at least one embodiment, the security monitoring/reporting system may be further adapted to transmit various types of information to external devices/systems such as, for example: security management systems, the local gaming device, remote gaming devices, gaming machines, game tables, mobile or handheld device, and/or other devices or systems of the gaming network. In at least one embodiment, one or more of these external devices/systems may be configured or designed to be compatible with one or more low-cost, low-power consumption, two-way, wireless communications standards such as, for example, one or more of the ZigBee Alliance specifications published by ZigBee Alliance, Inc. of San Ramon, Calif. (www.zigbee.org). An example of one such standard is described in the ZigBee Specification Document 053474r17, published Jan. 17, 2008, by ZigBee Alliance, Inc., the entirety of which is herein incorporated by reference for all purposes.

According to specific embodiments, examples of the various types of different information which may be transmitted by the security monitoring/reporting system may include, but are not limited to, one or more of the following (or combinations thereof):

- security-related information;
- gaming device state information;
- historical game data;
- critical information;
- game state data;
- wager related data;
- information relating to events, conditions and/or movements occurring at the gaming device (such as, for example, time data, location data, acceleration/deceleration data, velocity data, displacement data, orientation data, etc);
- information which may be desired and/or used for reconstructing conditions and/or events at the gaming device before, during and/or after the detected event or condition;
- security monitoring/reporting system ID;
- gaming device ID;
- player ID information;
- etc.

Figure 4:
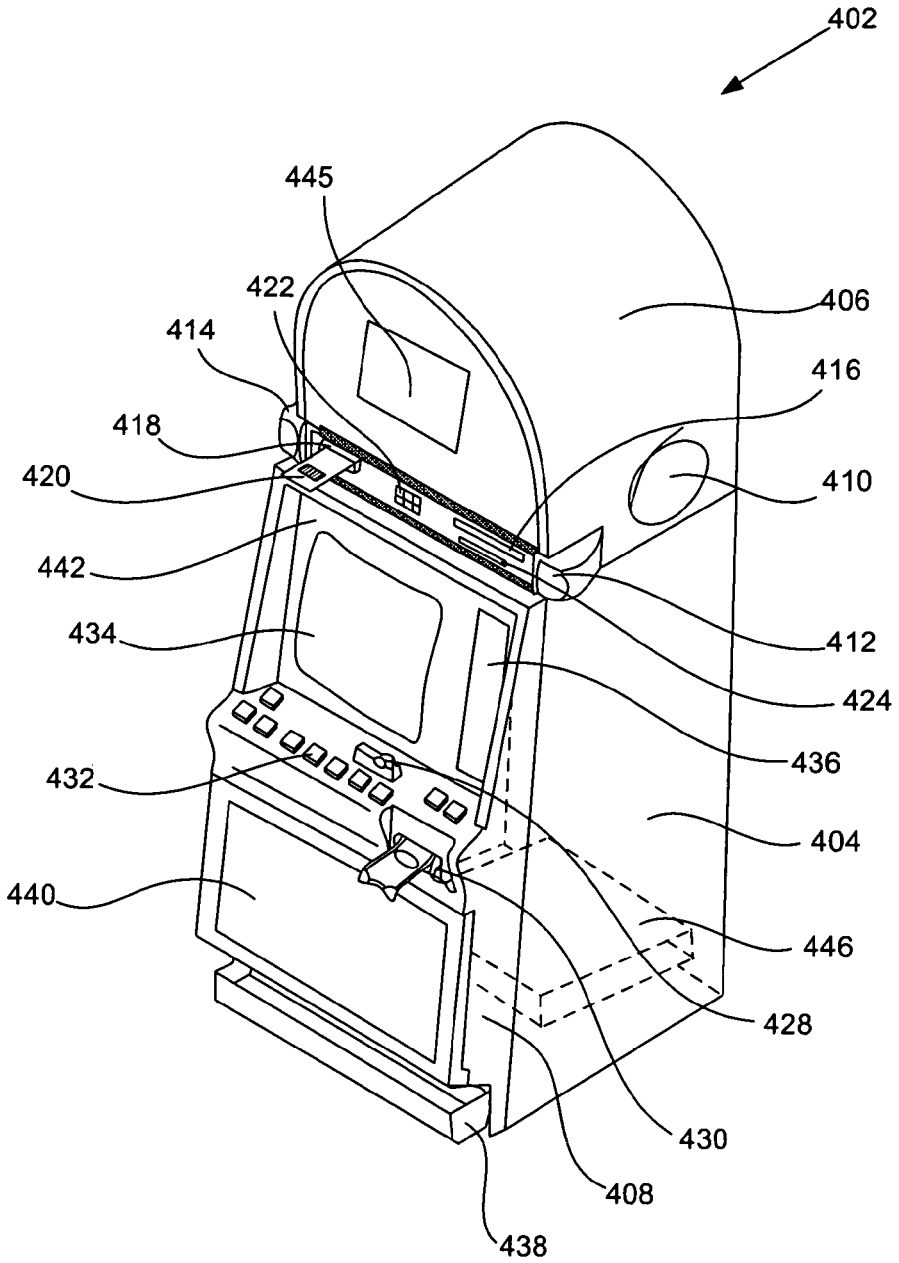
FIG. 4 shows a perspective view of an example gaming device in accordance with a specific embodiment.

FIG. 4 shows a perspective view of an example gaming device 402 in accordance with a specific embodiment. As illustrated in the example of FIG. 4, device 402 includes a main cabinet or housing 404, which generally surrounds the device interior and is viewable by users. The main cabinet includes an access door 408, which opens to provide access to the interior of the device.

In particular embodiments, the gaming device may be controlled by software executed by a master gaming controller 446 in conjunction with software executed by a remote logic device (e.g., a remote host, a central server or a central controller) in communication with the gaming device. The master gaming controller may execute externally-controlled interface (ECI) processes which, for example, may enable content generated and managed on the remote host to be output on the gaming device. The gaming device may receive and send events to the remote host that may affect the content output by one or more ECI processes as well as enable an ECI process to be initiated on the gaming device.

In one embodiment, attached to the main door is at least one payment acceptor 428 and a bill validator 430, and a coin tray 438. In one embodiment, the payment acceptor may include a coin slot and a payment, note or bill acceptor, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the master gaming controller 446 or another logic device coupled to the gaming device determines the amount of funds entered and displays the corresponding amount on the credit or other suitable display as described above.

In one embodiment attached to the main door are a plurality of player-input switches or buttons 432. The input switches can include any suitable devices which enables the player to produce an input signal which is received by the processor. In one embodiment, after appropriate funding of the gaming device, the input switch is a game activation device, such as a pull arm or a play button which is used by the player to start any primary game or sequence of events in the gaming device. The play button can be any suitable play activator such as a bet one button, a max bet button or a repeat the bet button. In one embodiment, upon appropriate funding, the gaming device may begin the game play automatically. In another embodiment, upon the player engaging one of the play buttons, the gaming device may automatically activate game play.

In one embodiment, one input switch is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input switch is a bet max button (not shown), which enables the player to bet the maximum wager permitted for a game of the gaming device.

In one embodiment, one input switch is a cash-out button. The player may push the cash-out button and cash out to receive a cash payment or other suitable form of payment corresponding to the number of remaining credits. In one embodiment, when the player cashes out, the player may receive the coins or tokens in a coin payout tray. In one embodiment, when the player cashes out, the player may receive other payout mechanisms such as tickets or credit slips redeemable by a cashier (or other suitable redemption system) or funding to the player's electronically recordable identification card. Details of ticketing or voucher system that may be utilized with at least one embodiment described herein are described in co-pending U.S. patent application Ser. No. 10/406,911, filed Apr. 2, 2003, by Rowe, et al., and entitled, "Cashless Transaction Clearinghouse," which is incorporated herein by reference and for all purposes.

In one embodiment, one input switch is a touch-screen coupled with a touch-screen controller, or some other touch-sensitive display overlay to enable for player interaction with the images on the display. The touch-screen and the touch-screen controller may be connected to a video controller. A player may make decisions and input signals into the gaming device by touching the touch-screen at the appropriate places. One such input switch is a touch-screen button panel.

In one embodiment, the gaming device may further include a plurality of communication ports for enabling communication of the gaming device processor with external peripherals, such as external video sources, expansion buses, game or other displays, an SCSI port or a key pad.

As seen in FIG. 4, viewable through the main door is a video display monitor 434 and an information panel 436. The display monitor 434 will typically be a cathode ray tube, high resolution flat-panel LCD, SED based-display, plasma display, a television display, a display based on light emitting diodes (LED), a display based on a plurality of organic light-emitting diodes (OLEDs), a display based on polymer light-emitting diodes (PLEDs), a display including a projected and/or reflected image or any other suitable electronic device or display. The information panel 436 or belly-glass 440 may be a static back-lit, silk screened glass panel with lettering to indicate general game information including, for example, a game denomination (e.g. $0.25 or $1) or a dynamic display, such as an LCD, an OLED or E-INK display. In another embodiment, at least one display device may be a mobile display device, such as a PDA or tablet PC, that enables play of at least a portion of the primary or secondary game at a location remote from the gaming device. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like. In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia. In another embodiment, the display device may include an electromechanical device adjacent to a video display, such as a video display positioned in front of a mechanical reel. In another embodiment, the display device may include dual layered video displays which co-act to generate one or more images.

The bill validator 430, player-input switches 432, video display monitor 434, and information panel are gaming devices that may be used to play a game on the game device 402. Also, these devices may be utilized as part of an ECI provided on the gaming device. According to a specific embodiment, the devices may be controlled by code executed by a master gaming controller 446 housed inside the main cabinet 404 of the device 402. The master gaming controller may include one or more processors including general purpose and specialized processors, such as graphics cards, and one or more memory devices including volatile and non-volatile memory. The master gaming controller 446 may periodically configure and/or authenticate the code executed on the gaming device.

In one embodiment, the gaming device may include a sound generating device coupled to one or more sounds cards. In one embodiment, the sound generating device includes at least one and preferably a plurality of speakers or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming device may include a sensor, such as a camera that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

In another embodiment, the gaming devices on the gaming device may be controlled by code executed by the master gaming controller 446 (or another logic device coupled to or in communication with the gaming device, such as a player tracking controller) in conjunction with code executed by a remote logic device in communication with the master gaming controller 446. In at least one embodiment, the master gaming controller 446 may execute ECI processes that enable content generated and managed on a remote host to be output on the gaming device. The gaming device may receive and send events to a remote host that may affect the content output on an instantiation of a particular ECI. The master gaming controller 446 may be configured to limit the resources that can be utilized by the ECI processes executing on the gaming device at any given time and may constantly monitor resources utilized by the ECI processes to ensure that gaming experience on the gaming device is optimal.

Games Played

Many different types of games, including mechanical slot games, video slot games, video poker, video black jack, video pachinko and lottery, may be provided with gaming devices of this present invention. In particular, the gaming device 402 may be operable to provide a play of many different games of chance. The games may be differentiated according to themes, sounds, graphics, type of game (e.g., slot game vs. card game), denomination, number of paylines, maximum jackpot, progressive or non-progressive, bonus games, etc.

In one embodiment, the gaming device 402 may be operable to enable a player to select a game of chance to play from a plurality of different games available on the gaming device. For example, the gaming device may provide a menu with a list of the different games that are available for play on the gaming device and a player may be able to select from the list a first game of chance that they wish to play. In one such embodiment, a memory device of the remote host stores different game programs and instructions, executable by a gaming device processor, to control the gaming device. Each executable game program represents a different game or type of game, which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In one such embodiment, each gaming device includes at least one or more display devices and/or one or more input switches for interaction with a player. A local processor, such as the above-described gaming device processor or a processor of a local server, is operable with the display device(s) and/or the input switch(s) of one or more of the gaming devices. In operation, the remote host is operable to communicate one or more of the stored game programs to at least one local gaming device processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. In different embodiments, the stored game programs are downloaded in response to a player inserting a player tracking card, a player selecting a specific game program, a player inserting a designated wager amount, the remote host communicating data to the gaming device regarding an upcoming tournament or promotion or any other suitable trigger. After the stored game programs are communicated from the remote host, the local gaming device processor executes the communicated program to facilitate play of the communicated program by a player through the display device(s) and/or input switch(s) of the gaming device. That is, when a game program is communicated to a local gaming device processor, the local gaming device processor changes the game or type of game played at the gaming device.

In particular embodiments, the master gaming controller 446 may provide information to a remote host providing content to an ECI on the gaming device 402 that enables the remote host to select graphical and audio themes for the ECI content that matches the theme of the game graphics and game sounds currently played on the gaming device 402.

In one embodiment, the various games available for play on the gaming device 402 may be stored as game software on a mass storage device in the gaming device. In one such embodiment, the memory device of the gaming device stores program codes and instructions, executable by the gaming device processor, to control the games available for play on the gaming device. The memory device also stores other data such as image data, event data, player input data, random or pseudo-random number generators, pay-table data or information and applicable game rules that relate to the play of the gaming device. In another embodiment, the games available for play on the gaming device may be generated on a remote gaming device but then displayed on the gaming device.

In one embodiment, the gaming device 402 may execute game software, such as but not limited to video streaming software that enables the game to be displayed on the gaming device. When a game is stored on the gaming device 402, it may be loaded from the mass storage device into a RAM for execution. In some cases, after a selection of a game, the game software that enables the selected game to be generated may be downloaded from a remote gaming device, such as another gaming device.

As illustrated in the example of FIG. 4, the gaming device 402 includes a top box 406, which sits on top of the main cabinet 404. The top box 406 houses a number of devices, which may be used to add features to a game being played on the gaming device 402, including speakers 410, 412, 414, a ticket printer 418 which prints bar-coded tickets 420, a key pad 422 for entering player tracking information, a display 416 (e.g., a video LCD display) for displaying player tracking information, a card reader 424 for entering a magnetic striped card containing player tracking information, and a video display screen 45. The ticket printer 418 may be used to print tickets for a cashless ticketing system. Further, the top box 406 may house different or additional devices not illustrated in FIG. 4. For example, the top box may include a bonus wheel or a back-lit silk screened panel which may be used to add bonus features to the game being played on the gaming device. As another example, the top box may include a display for a progressive jackpot offered on the gaming device. During a game, these devices are controlled and powered, in part, by circuitry (e.g. a master gaming controller 446) housed within the main cabinet 404 of the device 402.

It will be appreciated that gaming device 402 is but one example from a wide range of gaming device designs on which at least one embodiment described herein may be implemented. For example, not all suitable gaming devices have top boxes or player tracking features. Further, some gaming devices have only a single game display—mechanical or video, while others may have multiple displays.

Networks

In various embodiments, the remote gaming device may be connected to the host computer via a network of some type such as a local area network, a wide area network, an intranet or the Internet. In one such embodiment, a plurality of the gaming devices may be capable of being connected together through a data network. In one embodiment, the data network is a local area network (LAN), in which one or more of the gaming devices are substantially proximate to each other and an on-site remote host as in, for example, a gaming establishment or a portion of a gaming establishment. In another embodiment, the data network is a wide area network (WAN) in which one or more of the gaming devices are in communication with at least one off-site remote host. In this embodiment, the plurality of gaming devices may be located in a different part of the gaming establishment or within a different gaming establishment than the off-site remote host. Thus, the WAN may include an off-site remote host and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, the remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming device or server may include gaming logic for commanding a remote gaming device to render an image from a virtual camera in a 3-D gaming environments stored on the remote gaming device and to display the rendered image on a display located on the remote gaming device. In addition, various combinations of gaming devices are possible on the gaming device. For example, some gaming device only accept cash, cashless vouchers or electronic fund transfers and do not include coin acceptors or coin hoppers. Thus, those of skill in the art will understand that at least one embodiment described herein, as described below, can be deployed on most any gaming device now available or hereafter developed.

In another embodiment, the gaming device disclosed herein is operable over a wireless network, such as part of a wireless gaming system. In this embodiment, the gaming device may be a hand held device, a mobile device or any other suitable wireless device that enables a player to play any suitable game at a variety of different locations. It should be appreciated that a gaming device as disclosed herein may be a device that has obtained approval from a regulatory gaming commission or a device that has not obtained approval from a regulatory gaming commission.

Gaming Device Vs. General-Purpose Computer

Some preferred gaming devices of the present assignee are implemented with special features and/or additional circuitry that differentiates them from general-purpose computers (e.g., desktop PC's and laptops). Gaming devices are highly regulated to ensure fairness and, in many cases, gaming devices are operable to dispense monetary awards of multiple millions of dollars. Therefore, to satisfy security and regulatory requirements in a gaming environment, hardware and software architectures may be implemented in gaming devices that differ significantly from those of general-purpose computers. A description of gaming devices relative to general-purpose computing devices and some examples of the additional (or different) components and features found in gaming devices are described below.

At first glance, one might think that adapting PC technologies to the gaming industry would be a simple proposition because both PCs and gaming devices employ microprocessors that control a variety of devices. However, because of such reasons as 1) the regulatory requirements that are placed upon gaming devices, 2) the harsh environment in which gaming devices operate, 3) security requirements and 4) fault tolerance requirements, adapting PC technologies to a gaming device can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming device because in a gaming device these faults can lead to a direct loss of funds from the gaming device, such as stolen cash or loss of revenue when the gaming device is not operating properly.

For the purposes of illustration, a few differences between PC systems and gaming devices/systems will be described. A first difference between gaming devices and common PC based computers systems is that gaming devices are designed to be state-based systems. In a state-based system, the system stores and maintains its current state in a non-volatile memory, such that, in the event of a power failure or other malfunction the gaming device will return to its current state when the power is restored. For instance, if a player was shown an award for a game of chance and, before the award could be provided to the player the power failed, the gaming device, upon the restoration of power, would return to the state where the award is indicated. As anyone who has used a PC, knows, PCs are not state devices and a majority of data is usually lost when a malfunction occurs. This requirement affects the software and hardware design on a gaming device.

A second important difference between gaming devices and common PC based computer systems is that for regulation purposes, the software on the gaming device used to generate the game of chance and operate the gaming device has been designed to be static and monolithic to prevent cheating by the operator of gaming device. For instance, one solution that has been employed in the gaming industry to prevent cheating and satisfy regulatory requirements has been to manufacture a gaming device that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming device in the presence of a gaming regulator. Regardless of whether the EPROM solution is used, to gain approval in most gaming jurisdictions, a gaming device must demonstrate sufficient safeguards that prevent an operator or player of a gaming device from manipulating hardware and software in a manner that gives them an unfair and some cases an illegal advantage. The gaming device should have a means to determine if the code it will execute is valid. If the code is not valid, the gaming device must have a means to prevent the code from being executed. The code validation requirements in the gaming industry affect both hardware and software designs on gaming devices.

A third important difference between gaming devices and common PC based computer systems is the number and kinds of peripheral devices used on a gaming device are not as great as on PC based computer systems. Traditionally, in the gaming industry, gaming devices have been relatively simple in the sense that the number of peripheral devices and the number of functions the gaming device has been limited. Further, in operation, the functionality of gaming devices were relatively constant once the gaming device was deployed, i.e., new peripherals devices and new gaming software were infrequently added to the gaming device. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming device, gaming devices still have unique device requirements that differ from a PC, such as device security requirements not usually addressed by PCs. For instance, monetary devices, such as coin dispensers, bill validators and ticket printers and computing devices that are used to govern the input and output of cash to a gaming device have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming devices that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

For example, a watchdog timer is normally used in International Game Technology (IGT) gaming devices to provide a software failure detection mechanism. In a normally operating system, the operating software periodically accesses control registers in the watchdog timer subsystem to "retrigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming devices of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

One standard method of operation for IGT slot device game software is to use a state device. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming device.

In general, the gaming device does not advance from a first state to a second state until critical information that allows the first state to be reconstructed has been stored. This feature allows the game to recover operation to the current state of play in the event of a malfunction, loss of power, etc that occurred just prior to the malfunction. In at least one embodiment, the gaming device is configured or designed to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

In order to ensure the success of atomic transactions relating to critical information to be stored in the gaming device memory before a failure event (e.g., malfunction, loss of power, etc.), it is preferable that memory be used which includes one or more of the following criteria: direct memory access capability; data read/write capability which meets or exceeds minimum read/write access characteristics (such as, for example, at least 5.08 Mbytes/sec (Read) and/or at least 38.0 Mbytes/sec (Write)). Devices which meet or exceed the above criteria may be referred to as "fault-tolerant" memory devices, whereas it is which the above criteria may be referred to as "fault non-tolerant" memory devices.

Typically, battery backed RAM devices may be configured or designed to function as fault-tolerant devices according to the above criteria, whereas flash RAM and/or disk drive memory are typically not configurable to function as fault-tolerant devices according to the above criteria. Accordingly, battery backed RAM devices are typically used to preserve gaming device critical data, although other types of non-volatile memory devices may be employed. These memory devices are typically not used in typical general-purpose computers.

Thus, in at least one embodiment, the gaming device is configured or designed to store critical information in fault-tolerant memory (e.g., battery backed RAM devices) using atomic transactions. Further, in at least one embodiment, the fault-tolerant memory is able to successfully complete all desired atomic transactions (e.g., relating to the storage of gaming device critical information) within a time period of 200 milliseconds (ms) or less. In at least one embodiment, the time period of 200 mSec represents a maximum amount of time for which sufficient power may be available to the various gaming device components after a power outage event has occurred at the gaming device.

As described previously, the gaming device may not advance from a first state to a second state until critical information that allows the first state to be reconstructed has been atomically stored. This feature allows the game to recover operation to the current state of play in the event of a malfunction, loss of power, etc that occurred just prior to the malfunction. After the state of the gaming device is restored during the play of a game of chance, game play may resume and the game may be completed in a manner that is no different than if the malfunction had not occurred. Thus, for example, when a malfunction occurs during a game of chance, the gaming device may be restored to a state in the game of chance just prior to when the malfunction occurred. The restored state may include metering information and graphical information that was displayed on the gaming device in the state prior to the malfunction. For example, when the malfunction occurs during the play of a card game after the cards have been dealt, the gaming device may be restored with the cards that were previously displayed as part of the card game. As another example, a bonus game may be triggered during the play of a game of chance where a player is required to make a number of selections on a video display screen. When a malfunction has occurred after the player has made one or more selections, the gaming device may be restored to a state that shows the graphical presentation at the just prior to the malfunction including an indication of selections that have already been made by the player. In general, the gaming device may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming device and the state of the gaming device (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming device prior, during and/or after the disputed game to demonstrate whether the player was correct or not in their assertion. Further details of a state based gaming system, recovery from malfunctions and game history are described in U.S. Pat. No. 6,804,763, titled "High Performance Battery Backed RAM Interface", U.S. Pat. No. 6,863,608, titled "Frame Capture of Actual Game Play," U.S. application Ser. No. 10/243,104, titled, "Dynamic NV-RAM," and U.S. application Ser. No. 10/758,828, titled, "Frame Capture of Actual Game Play," each of which is incorporated by reference and for all purposes.

Another feature of gaming devices, such as IGT gaming computers, is that they often include unique interfaces, including serial interfaces, to connect to specific subsystems internal and external to the gaming device. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the gaming device, serial devices may be connected in a shared, daisy-chain fashion where multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from a gaming device to a remote device. Often SAS is used in conjunction with a player tracking system.

IGT gaming devices may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming device by monitoring security switches attached to access doors in the gaming device cabinet. Preferably, access violations result in suspension of game play and can trigger additional security operations to preserve the current state of game play. These circuits also function when power is off by use of a battery backup. In power-off operation, these circuits continue to monitor the access doors of the gaming device. When power is restored, the gaming device can determine whether any security violations occurred while power was off, e.g., via software for reading status registers. This can trigger event log entries and further data authentication operations by the gaming device software.

Trusted memory devices and/or trusted memory sources are preferably included in an IGT gaming device computer to ensure the authenticity of the software that may be stored on less secure memory subsystems, such as mass storage devices. Trusted memory devices and controlling circuitry are typically designed to not enable modification of the code and data stored in the memory device while the memory device is installed in the gaming device. The code and data stored in these devices may include authentication algorithms, random number generators, authentication keys, operating system kernels, etc. The purpose of these trusted memory devices is to provide gaming regulatory authorities a root trusted authority within the computing environment of the gaming device that can be tracked and verified as original. This may be accomplished via removal of the trusted memory device from the gaming device computer and verification of the secure memory device contents is a separate third party verification device. Once the trusted memory device is verified as authentic, and based on the approval of the verification algorithms included in the trusted device, the gaming device is enabled to verify the authenticity of additional code and data that may be located in the gaming computer assembly, such as code and data stored on hard disk drives. A few details related to trusted memory devices that may be used in at least one embodiment described herein are described in U.S. Pat. No. 6,685,567 from U.S. patent application Ser. No. 09/925,098, filed Aug. 8, 42001 and titled "Process Verification," which is incorporated herein in its entirety and for all purposes.

In at least one embodiment, at least a portion of the trusted memory devices/sources may correspond to memory which cannot easily be altered (e.g., "unalterable memory") such as, for example, EPROMS, PROMS, Bios, Extended Bios, and/or other memory sources which are able to be configured, verified, and/or authenticated (e.g., for authenticity) in a secure and controlled manner.

According to a specific implementation, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment of at least one embodiment described herein, the remote device and the trusted information source may engage in methods using zero knowledge proofs to authenticate each of their respective identities.

Gaming devices storing trusted information may utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

Additional details relating to trusted memory devices/sources are described in U.S. patent application Ser. No. 11/078,966, entitled "Secured Virtual Network in a Gaming Environment", naming Nguyen et al. as inventors, filed on Mar. 10, 2005, herein incorporated in its entirety and for all purposes.

Mass storage devices used in a general purpose computer typically enable code and data to be read from and written to the mass storage device. In a gaming device environment, modification of the gaming code stored on a mass storage device is strictly controlled and would only be enabled under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. Details using a mass storage device that may be used with at least one embodiment described herein are described, for example, in U.S. Pat. No. 6,149,522, herein incorporated by reference in its entirety for all purposes.

Game Play

Returning to the example of FIG. 4, when a user wishes to play the gaming device 402, he or she inserts a ticket or cash through the payment or coin acceptor 428 or bill validator 430. Additionally, the bill validator may accept a printed ticket voucher, which may be accepted by the bill validator 430 as an indicia of credit when a cashless ticketing system is used. At the start of the game, the player may enter playing tracking information using the card reader 424, the keypad 422, and the florescent display 416. Further, other game preferences of the player playing the game may be read from a card inserted into the card reader. During the game, the player views game information using the video display 434. Other game and prize information may also be displayed in the video display screen 45 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 432, the video display screen 434 or using some other device which enables a player to input information into the gaming device. In some embodiments, the player may be able to access various game services such as concierge services and entertainment content services using the video display screen 434 and one more input devices.

During certain game events, the gaming device 402 may display visual and auditory effects that can be perceived by the player. These effects add to the excitement of a game, which makes a player more likely to continue playing. Auditory effects include various sounds that are projected by the speakers 410, 412, 414. Visual effects include flashing lights, strobing lights or other patterns displayed from lights on the gaming device 402 or from lights behind the belly glass 440. After the player has completed a game, the player may receive game tokens from the coin tray 438 or the ticket 420 from the printer 418, which may be used for further games or to redeem a prize. Further, the player may receive a ticket 420 for food, merchandise, or games from the printer 418.

In at least one embodiment, gaming device can incorporate any suitable wagering primary or base game. The gaming device or device may include some or all of the features of conventional gaming devices or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, a base or primary game may be a slot game with one or more paylines. The paylines may be horizontal, vertical, circular, diagonal, angled or any combination thereof. In this embodiment, the gaming device includes at least one and preferably a plurality of reels, such as three to five reels, in either electromechanical form with mechanical rotating reels or video form with simulated reels and movement thereof. In one embodiment, an electromechanical slot device includes a plurality of adjacent, rotatable reels, which may be combined and operably coupled with an electronic display of any suitable type. In another embodiment, if the reels are in video form, one or more of the display devices, as described above, display the plurality of simulated video reels. Each reel displays a plurality of indicia or symbols, such as bells, hearts, fruits, numbers, letters, bars or other images, which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device may enable a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming device enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols, which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming device deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits or other awards in a base or primary game, as described above, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game. In other embodiments, the triggering event or qualifying condition may be by exceeding a certain amount of game play (such as number of games, number of credits, amount of time), or reaching a specified number of points earned during game play.

In another embodiment, the gaming device processor or remote host randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or remote host) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 5:
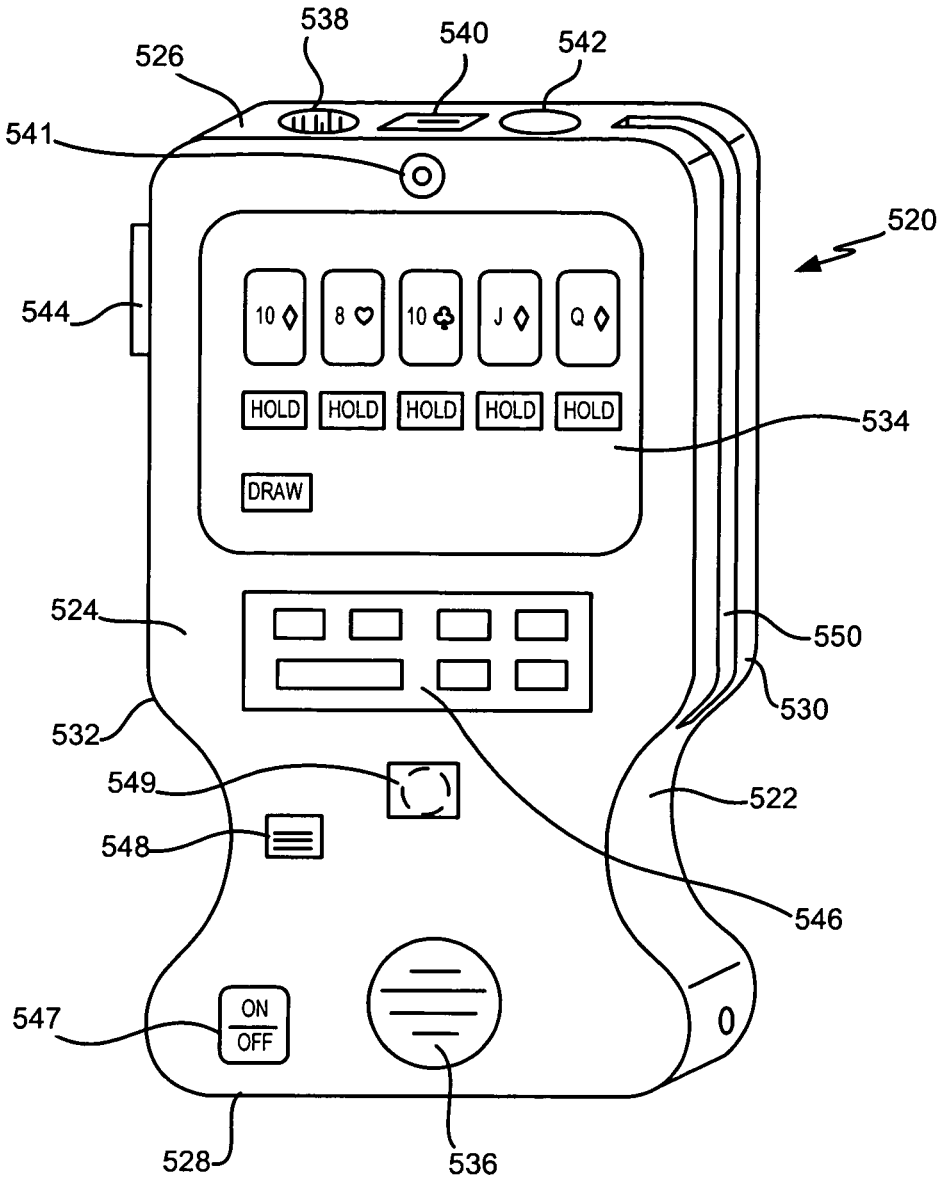
FIG. 5 is a perspective drawing of an exemplary mobile gaming device in accordance with one embodiment of the present invention.

FIG. 5 illustrates an example of a gaming device (PGD) 520 in accordance with one embodiment. In general, PGD 520 includes a body or housing 522. Body 522 may be constructed from a wide variety of materials and be in one of many shapes. In one embodiment, the body 522 is constructed from one or more molded polypropylene or other plastic components. The body 522 may be constructed of metal or a wide variety of other materials. As illustrated, the body 522 is generally rectangular in shape, having a front side or face 524, a rear side or face (not visible), a top end 526, a bottom end 528, a first side 530 and a second side 532. Preferably, the body 522 defines an enclosed interior space (not shown) in which a variety of components are located as described below.

In a preferred embodiment, PGD 520 is adapted to present video and sound game data to a player. As illustrated, PGD 520 includes a display 534. The display is located in the front face 524 of the body 522, thus facing upwardly towards a player. In a preferred embodiment, the display 534 comprises a liquid crystal display ("LCD"), and in particular, an LCD permitting touch-screen input. It will be appreciated that other types of displays may be provided such as, for example, EL displays, OLED displays, multi-layer displays, etc. gaming device 520 also includes a sound-generating device in the form of at least one speaker 536. In one embodiment, the speaker 536 is positioned beneath a top or cover portion of the body 522 having one or more perforations or apertures therein through which the sound may readily travel. As illustrated, the speaker 536 is located near the bottom end 528 of the body 522, generally opposite the display 534. It will be appreciated that the speaker 536 or additional speakers may be provided in a wide variety of locations, such as at one or both sides 530, 532 of the body 522.

In a preferred embodiment, PGD 520 is adapted to send and/or receive data from another device. As such, PGD 520 includes one or more data input and/or output devices or interfaces. In one embodiment, PGD 520 includes an RS-232 data port 538 for transmitting and accepting data, such as through a cable extending between PGD 520 and another device, such as a computer. In one embodiment, PGD 520 includes a USB data port 540 for transmitting and accepting data, also through a cable. In one embodiment, PGD 520 includes an infrared data transmitter/receiver 542 for transmitting information in wireless, infrared light form. In a preferred embodiment, PGD 520 includes another wireless communication device 544, such as a wireless communication device/interface operating at radio frequency, such as in accordance with the IEEE-802.11x or the Bluetooth standard, or operating according to NFM standards as described above.

A user provides input to PGD 520, such as for playing a wagering game or for a non-gaming service. As stated above, one means of input may be through the display 534. The display 534 may also be arranged to accept input via a stylus or other device. In one embodiment, PGD 520 includes a keypad 546. In one or more embodiments, the keypad 546 is a sealed keypad having one or more keys or buttons. PGD 520 can include a microphone 548 arranged to accept voice input from a player. A smart card reader, optical reader or other input device may be provided for reading information from another element, such as a card, ticket or the like. gaming device may also include a keyboard or mouse.

Other input interfaces may alternatively be provided or be provided in addition to those input devices described. For example, the gaming device may be configured or designed to allow a user to provide input via one or more physical gestures and/or via the use of a wireless user input device. Various examples of such alternate input interfaces are described, for example, in U.S. patent application Ser. No. 11/825,481, by Mattice, et al., entitled "GESTURE CONTROLLED CASINO GAMING SYSTEM," filed Jul. 6, 2007, the entirety of which is incorporated herein by reference for all purposes.

In one embodiment, PGD 520 includes an image collection device 541, such as a camera. The image collection device 541 may be used, for example, to capture the image of a user or player of PGD 520. This image information may be used for security or authentication purposes, as set forth in greater detail below. PGD 520 may also include a fingerprint scanner 549 and/or other types of bio-information/authentication component(s). In one embodiment, as illustrated, the fingerprint scanner 549 may be located behind or beneath a user input button, such as a "spin" or "draw" button. In this manner, a player's fingerprint may be obtained without the user or player having to be consciously aware that a fingerprint is being provided participate (although informed, for example during device registration and check out, that a fingerprint can be taken when the buttons are pressed). In one embodiment, a player's scanned fingerprint information may be used for authentication purposes. PGD 520 may also include a card reader 550. As illustrated, the card reader 550 is located in a side 530 of the body 522 of PGD 520. In a preferred embodiment, the card reader 550 comprises a magnetic stripe reader for reading information from a magnetic stripe of a card. The card reader may also be adapted to write or store data to a smart card or memory module.

As illustrated, the card reader 550 includes a slot that is positioned in the side 530 of PGD 520. PGD 520 may be battery-powered, such as with a rechargeable battery pack. An ON/OFF button 547 may be provided for controlling the power to PGD 520. As described in greater detail below, PGD 520 may be docked at or otherwise associated with a free-standing electronic gaming machine or other gaming device. At such times that PGD 520 is docked, the internal battery of the device can be recharged for later use in an undocked or "remote" mode, as will be readily appreciated. Appropriate detection provisions, warnings and safeguards for a low battery status in gaming device 520 while in such a remote mode can also be provided.

In at least one embodiment, gaming device 520 includes control mechanisms for controlling the operation of the device, including accepting input and providing output.

Figure 6:
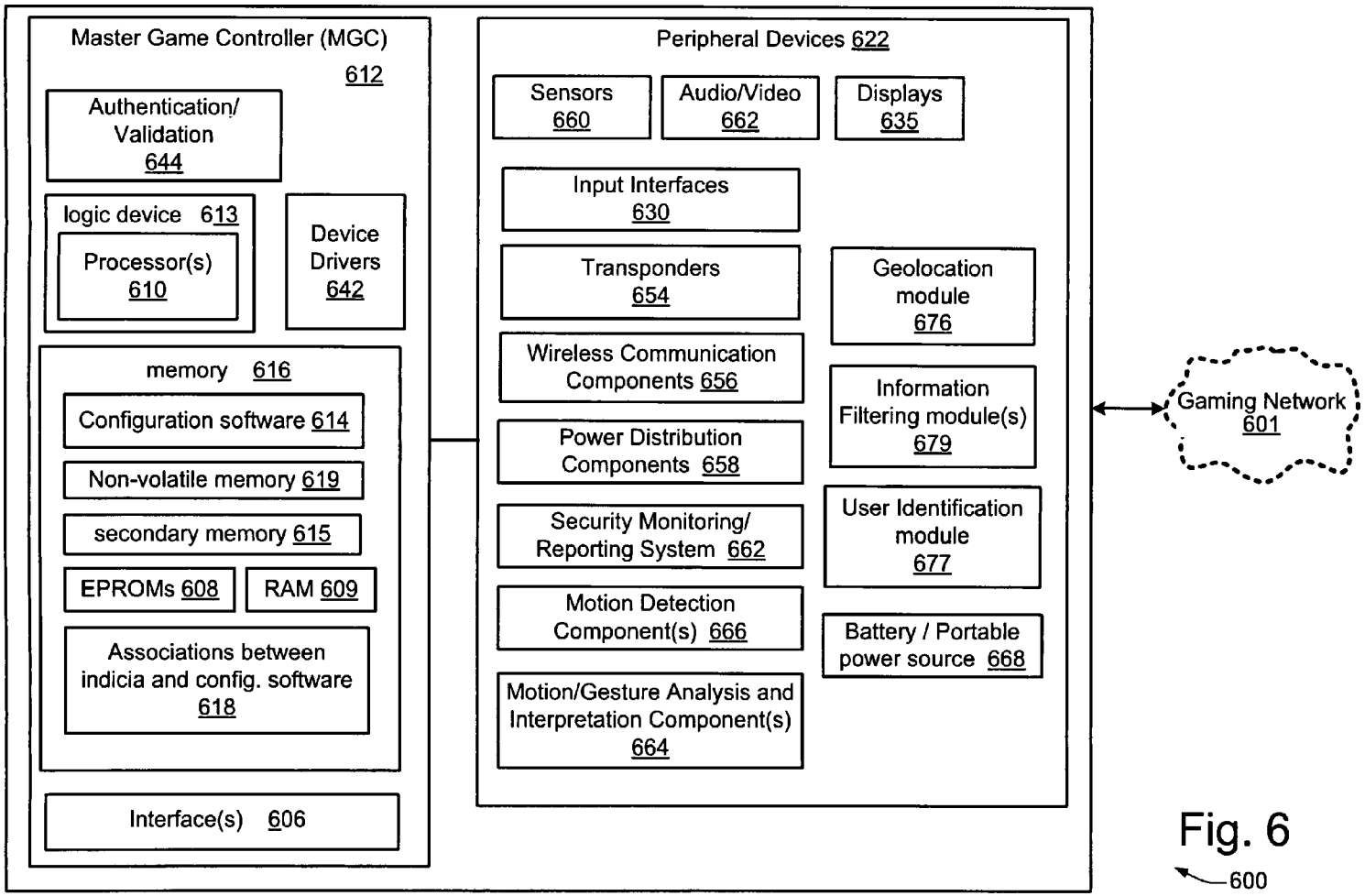
FIG. 6 is a simplified block diagram of an exemplary gaming device 100 in accordance with a specific embodiment.

FIG. 6 is a simplified block diagram of an example gaming device 600 in accordance with a specific embodiment. According to different embodiments, different gaming devices may be implemented using one or more components of the gaming device 600 of FIG. 6.

As illustrated in the embodiment of FIG. 6, gaming device 600 includes at least one processor 610, at least one interface 606, and memory 616.

In one implementation, processor 610 and master game controller 612 are included in a logic device 613 enclosed in a logic device housing. The processor 610 may include any conventional processor or logic device configured to execute software allowing various configuration and reconfiguration tasks such as, for example: a) communicating with a remote source via communication interface 606, such as a server that stores authentication information or game information; b) converting signals read by an interface to a format corresponding to that used by software or memory in the gaming device; c) accessing memory to configure or reconfigure game parameters in the memory according to indicia read from the device; d) communicating with interfaces, various peripheral devices 622 and/or I/O devices; e) operating peripheral devices 622 such as, for example, card readers, paper ticket readers, etc.; f) operating various I/O devices such as, for example, displays 635, input devices 630; etc. For instance, the processor 610 may send messages including game play information to the displays 635 to inform players of cards dealt, wagering information, and/or other desired information.

The gaming device 600 also includes memory 616 which may include, for example, volatile memory (e.g., RAM 609), non-volatile memory 619 (e.g., disk memory, FLASH memory, EPROMs, etc.), unalterable memory (e.g., EPROMs 608), etc. The memory may be configured or designed to store, for example: 1) configuration software 614 such as all the parameters and settings for a game playable on the gaming device; 2) associations 618 between configuration indicia read from a device with one or more parameters and settings; 3) communication protocols allowing the processor 610 to communicate with peripheral devices 622 and I/O devices 611; 4) a secondary memory storage device 615 such as a non-volatile memory device, configured to store gaming software related information (the gaming software related information and memory may be used to store various audio files and games not currently being used and invoked in a configuration or reconfiguration); 5) communication transport protocols (such as, for example, TCP/IP, USB, Firewire, IEEE1394, Bluetooth, IEEE 802.11x (IEEE 802.11 standards), hiperlan/2, HomeRF, etc.) for allowing the gaming device to communicate with local and non-local devices using such protocols; etc. In one implementation, the master game controller 612 communicates using a serial communication protocol. A few examples of serial communication protocols that may be used to communicate with the master game controller include but are not limited to USB, RS-232 and Netplex (a proprietary protocol developed by IGT, Reno, Nev.).

A plurality of device drivers 642 may be stored in memory 616. Example of different types of device drivers may include device drivers for gaming device components, device drivers for peripheral components 622, etc. Typically, the device drivers 642 utilize a communication protocol of some type that enables communication with a particular physical device. The device driver abstracts the hardware implementation of a device. For example, a device drive may be written for each type of card reader that may be potentially connected to the gaming device. Examples of communication protocols used to implement the device drivers include Netplex, USB, Serial, Ethernet, Firewire, I/O debouncer, direct memory map, serial, PCI, parallel, RF, Bluetooth™, near-field communications (e.g., using near-field magnetics), 802.11 (WiFi), etc. Netplex is a proprietary IGT standard while the others are open standards. According to a specific embodiment, when one type of a particular device is exchanged for another type of the particular device, a new device driver may be loaded from the memory 616 by the processor 610 to allow communication with the device. For instance, one type of card reader in gaming device 600 may be replaced with a second type of card reader where device drivers for both card readers are stored in the memory 616.

In some embodiments, the software units stored in the memory 616 may be upgraded as needed. For instance, when the memory 616 is a hard drive, new games, game options, various new parameters, new settings for existing parameters, new settings for new parameters, device drivers, and new communication protocols may be uploaded to the memory from the master game controller 612 or from some other external device. As another example, when the memory 616 includes a CD/DVD drive including a CD/DVD designed or configured to store game options, parameters, and settings, the software stored in the memory may be upgraded by replacing a first CD/DVD with a second CD/DVD. In yet another example, when the memory 616 uses one or more flash memory 619 or EPROM 608 units designed or configured to store games, game options, parameters, settings, the software stored in the flash and/or EPROM memory units may be upgraded by replacing one or more memory units with new memory units which include the upgraded software. In another embodiment, one or more of the memory devices, such as the hard-drive, may be employed in a game software download process from a remote software server.

In some embodiments, the gaming device 600 may also include various authentication and/or validation components 644 which may be used for authenticating/validating specified gaming device components and/or information such as, for example, hardware components, software components, firmware components, peripheral device components, user input device components, information received from one or more user input devices, information stored in the gaming device memory 616, etc. Examples of various authentication and/or validation components are described in U.S. Pat. No. 6,620,047, entitled, "ELECTRONIC GAMING APPARATUS HAVING AUTHENTICATION DATA SETS," incorporated herein by reference in its entirety for all purposes.

Peripheral devices 622 may include several device interfaces such as, for example, one or more of the following (or combinations thereof): transponders 654, wire/wireless power distribution components 658, input interface(s) 630 (which, for example, may include contact and/or non-contact interfaces), sensors 660, audio and/or video devices 662 (e.g., cameras, speakers, etc.), wireless communication components 656, motion/gesture analysis and interpretation component(s) 664, data preservation components 662, motion detection components 666, geolocation components 676, information filtering components 679, user identification components 677, one or more power sources 668, etc.

Sensors 660 may include, for example, optical sensors, pressure sensors, RF sensors, Infrared sensors, image sensors, thermal sensors, biometric sensors, etc. Such sensors may be used for a variety of functions such as, for example: detecting movements and/or gestures of various objects within a predetermined proximity to the gaming device; detecting the presence and/or identity of various persons (e.g., players, casino employees, etc.), devices (e.g., user input devices), and/or systems within a predetermined proximity to the gaming device.

In one implementation, at least a portion of the sensors 660 and/or input devices 630 may be implemented in the form of touch keys selected from a wide variety of commercially available touch keys used to provide electrical control signals. Alternatively, some of the touch keys may be implemented in another form which are touch sensors such as those provided by a touchscreen display. For example, in at least one implementation, the gaming device player displays may include contact input interfaces and/or non-contact input interfaces for allowing players to provide desired information (e.g., game play instructions and/or other input) to the gaming device and/or other devices in the casino gaming network (such as, for example, player tracking systems, side wagering systems, etc.).

Wireless communication components 656 may include one or more communication interfaces having different architectures and utilizing a variety of protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information.

Power distribution components 658 may include, for example, components or devices which are operable for providing wired or wireless power to other devices. For example, in one implementation, the power distribution components 658 may include a magnetic induction system which is adapted to provide wireless power to one or more user input devices near the gaming device. In one implementation, a user input device docking region may be provided which includes a power distribution component that is able to recharge a user input device without requiring metal-to-metal contact. In at least one embodiment, power distribution components 658 may be operable to distribute power to one or more internal components such as, for example, one or more rechargeable power sources (e.g., rechargeable batteries) located at the gaming device, security monitoring/reporting system 662, etc.

In at least one embodiment, the gaming device may include a geolocation module 676 which, for example, may be configured or designed to acquire geolocation information from remote sources and use the acquired geolocation information to determine information relating to a relative and/or absolute position of the gaming device. For example, in one implementation, the geolocation module 646 may be adapted to receive GPS signal information for use in determining the position or location of the gaming device. In another implementation, the geolocation module 646 may be adapted to receive multiple wireless signals from multiple remote devices (e.g., gaming machines, servers, wireless access points, etc.) and use the signal information to compute position/location information relating to the position or location of the gaming device.

In at least one embodiment, the gaming device may include a user identification module 677. In one implementation, the user identification module may be adapted to determine the identity of the current user or current owner of the gaming system/device. For example, in one embodiment, the current user may be required to perform a log in process at the gaming device in order to access one or more features. Alternatively, the gaming device may be adapted to automatically determine the identity of the current user based upon one or more external signals such as, for example, an RFID tag or badge worn by the current user which provides a wireless signal to the gaming device for determining the identity of the current user. In at least one implementation, various security features may be incorporated into the gaming device to prevent unauthorized users from accessing confidential or sensitive information.

In at least one embodiment, the gaming device may include an Information filtering module(s) 679.

In at least one embodiment, the gaming device may include at least one power source 668. In at least one implementation, the power source may include at least one battery or portable power source, which, for example, may be used to enable the gaming device to operate in a mobile environment and/or may be used as a backup power source in the event of a failure of a primary (e.g., A/C) power source. For example, in one implementation, the gaming device 600 may include one or more rechargeable batteries which, for example, may be implemented using a rechargeable, thin-film type battery.

In at least one embodiment, the gaming device may include at least one motion detection component 666 for detecting motion or movement of the gaming device and/or for detecting motion, movement, gestures from the user. In at least one embodiment, motion detection component(s) may include one or more of the following (or combinations thereof): accelerometer component(s), gyro component(s), camera component(s), rangefinder component(s), velocity transducer component(s), etc. In one embodiment, the motion detection component(s) may be operable to detect gross motion of a user (e.g., player, dealer, etc.).

In at least one embodiment, motion/gesture analysis and interpretation component(s) 664 may be operable to analyze and/or interpret information relating to detected player movements and/or gestures in order, for example, to determine appropriate player input information relating to the detected player movements and/or gestures. For example, in at least one embodiment, motion/gesture analysis and interpretation component(s) 664 may be operable to perform one or more functions such as, for example: analyze the detected gross motion or gestures of a participant; interpret the participant's motion or gestures (e.g., in the context of a casino game being played) in order to identify instructions or input from the participant; utilize the interpreted instructions/input to advance the game state; etc. In other embodiments, at least a portion of these additional functions may be implemented at a remote system or device.

For example, during play of a game of blackjack at a conventional game table, a player may signal "hit me" to the dealer by the player flicking or moving his cards in a sweeping motion towards the player. In at least one embodiment where the player is performing the "hit me" gesture using a gaming device, the gaming device may be adapted to automatically detect the player's gesture (e.g., gross motion) by sensing motion or movement (e.g., rotation, displacement, velocity, acceleration, etc.) using, for example, one or more motion detection sensors. In one embodiment, the gaming device may also be adapted to analyze the detected motion data in order to interpret the gesture (or other input data) intended by the player. Once interpreted, the gaming device may then provide the interpreted player input data (e.g., "hit me") to the gaming device (and/or other devices/systems) for advancement of the game state. Alternatively, the gaming device may be adapted to transmit information relating to the detected motion data to an external gaming device, and the external game system may be adapted to analyze the detected motion data in order to interpret the gesture (or other input data) intended by the player.

According to different embodiments, other criteria may also be used when analyzing the detected motion data for proper interpretation of the player's gestures and/or other input instructions. For example, the interpretation of the detected motion data may be constrained based on one or more of the following criteria (or combination thereof): type of game being played (e.g., craps, blackjack, poker, slots, etc.), location of the player/portable gaming device; current gaming device operating mode (e.g., table game operating mode, gaming machine operating mode, bonus game operating mode, restaurant operating mode, theater operating mode, lounge operating mode, hotel operating mode, parking service operating mode, room service operating mode, news magazine operating mode, etc.); game rules; time; player ID; player preferences; previous motion interpretation/analysis; and/or other criteria described herein.

In at least one embodiment, the gaming device may include a security monitoring/reporting system 662 which is configured or designed to detect or sense one or more security-related events and/or conditions at the gaming device. Additionally, the security monitoring/reporting system 662 may be operable to initiate one or more appropriate action(s) in response to the detection of such events/conditions.

In other embodiments (not shown) other peripheral devices include: player tracking devices, card readers, bill validator/paper ticket readers, etc. Such devices may each comprise resources for handling and processing configuration indicia such as a microcontroller that converts voltage levels for one or more scanning devices to signals provided to processor 610. In one embodiment, application software for interfacing with peripheral devices 622 may store instructions (such as, for example, how to read indicia from a device) in a memory device such as, for example, non-volatile memory, hard drive or a flash memory.

In at least one embodiment, the gaming device may include user input device control components may be operable to control operating mode selection functionality, features, and/or components associated with one or more user input devices which communication with the gaming device. For example, in at least one embodiment, the user input device control components may be operable to remotely control and/or configure components of one or more user input devices based on various parameters and/or upon detection of specific events or conditions such as, for example: time of day, player activity levels; location of the user input device; identity of user input device user; user input; system override (e.g., emergency condition detected); proximity to other devices belonging to same group or association; proximity to specific objects, regions, zones, etc.

In at least one implementation, the gaming device may include card readers such as used with credit cards, or other identification code reading devices to allow or require player identification in connection with play of the card game and associated recording of game action. Such a user identification interface can be implemented in the form of a variety of magnetic card readers commercially available for reading a user-specific identification information. The user-specific information can be provided on specially constructed magnetic cards issued by a casino, or magnetically coded credit cards or debit cards frequently used with national credit organizations such as VISA™, MASTERCARD™, banks and/or other institutions.

The gaming device may include other types of participant identification mechanisms which may use a fingerprint image, eye blood vessel image reader, or other suitable biological information to confirm identity of the user. Still further it is possible to provide such participant identification information by having the dealer manually code in the information in response to the player indicating his or her code name or real name. Such additional identification could also be used to confirm credit use of a smart card, transponder, and/or player's user input device.

It will be apparent to those skilled in the art that other memory types, including various computer readable media, may be used for storing and executing program instructions pertaining to the operation of various gaming devices described herein. Because such information and program instructions may be employed to implement the systems/methods described herein, example embodiments may relate to machine-readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). Example embodiments may also be embodied in transmission media such as a carrier wave traveling over an appropriate medium such as airwaves, optical lines, electric lines, etc. Examples of program instructions include both machine code, such as produced by a compiler, and files including higher level code that may be executed by the computer using an interpreter.

According to specific embodiments, at least some embodiments of various gaming devices, gaming machines, and/or gaming devices described herein (collectively referred to herein as "gaming devices"), may be implemented with special features and/or additional circuitry that differentiate such gaming devices from general-purpose computers (e.g., PC computers, PDAs, etc., collectively be referred to herein as "PCs").

Figure 7:
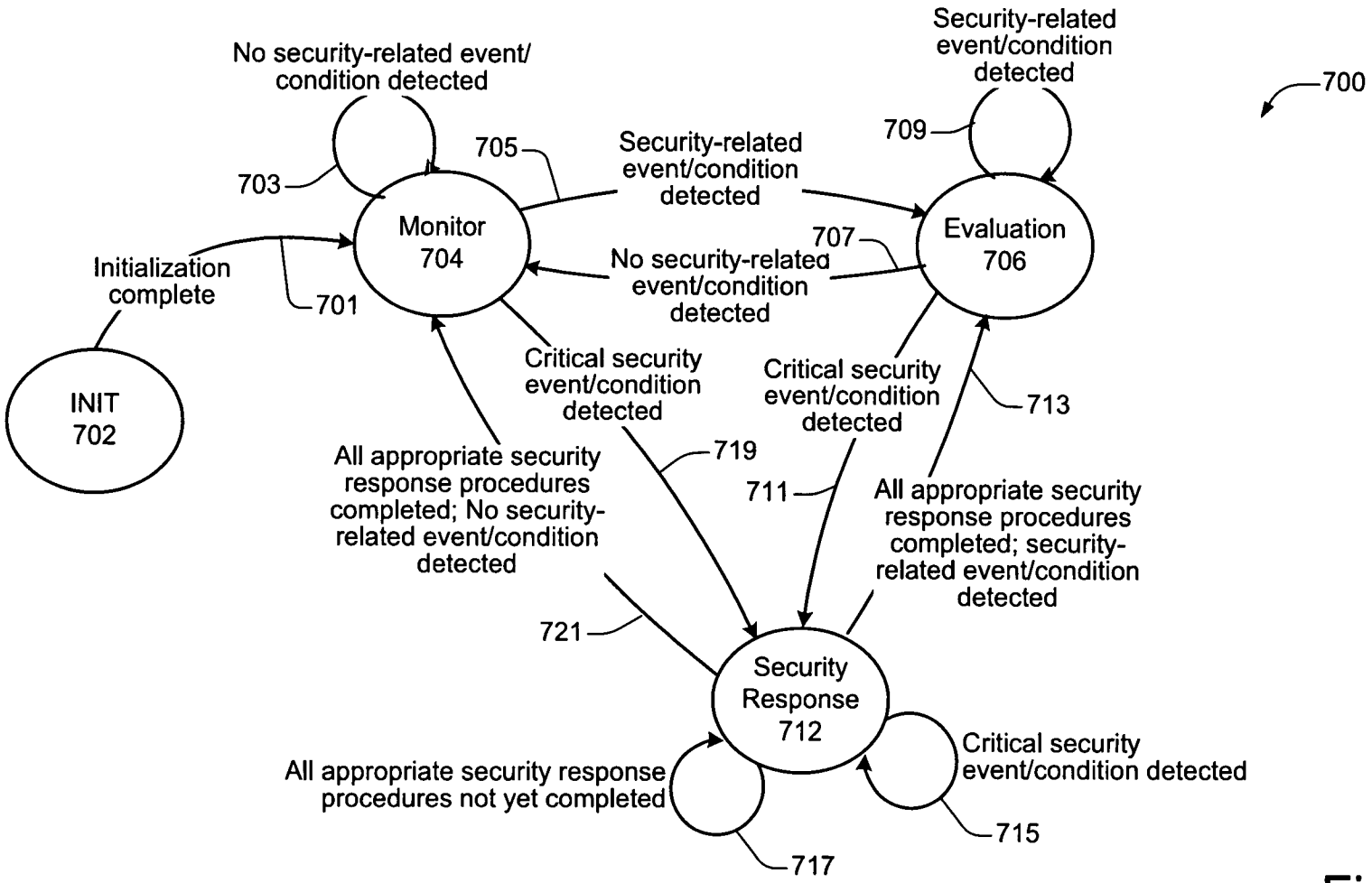
FIG. 7 shows an example embodiment of a state diagram 700 which may be used for implementing various aspects or features described herein.

FIG. 7 shows an example embodiment of a state diagram 700 which may be used for implementing various aspects or features described herein. In at least one embodiment, a least a portion of the operations and/or activities associated with state diagram 700 may be performed or implemented by one or more systems or components of a gaming device. In some embodiments, all or selected the operations and/or activities associated with state diagram 700 may be performed or implemented by a security monitoring/reporting system such as, for example, security monitoring/reporting system 300 of FIG. 3. Additionally, according to different embodiments, the various operations and/or activities associated with state diagram 700 may be implemented via hardware, software, and/or some combination thereof.

For purposes of illustration, a description of state diagram 700 will now be provided by way of example. In this particular example it is assumed that the operations and/or activities associated with state diagram 700 are performed or implemented at a security monitoring/reporting system which has been installed at a gaming device. In other embodiments at least a portion of the operations and/or activities associated with state diagram 700 may be performed or implemented by a gaming device which includes a security monitoring/reporting system.

As illustrated in the example of FIG. 7, state diagram 700 may include a plurality of different states including, for example, an initialization state 702, a monitor state 704, an evaluation state 706, a security response state 712, etc. In at least one embodiment, each of the different states 702, 704, 706, 712, may relate to (or be descriptive of) a different state of operation of the security monitoring/reporting system. In at least one embodiment, the currently active state of the security monitoring/reporting system may be independent from one or more concurrently active states at the gaming device.

According to one embodiment, during initialization state 702, the security monitoring/reporting system may perform any desired initialization procedures.

In one embodiment, the successful completion of the initialization procedures may trigger 701 advancement to monitor state 704.

In at least one embodiment, while in the monitor state 704, the security monitoring/reporting system (and/or selected systems, devices, components associated with the gaming device) may be operable to perform one or more of the following (or combinations thereof):

- Set or update a current power mode of operation of the security monitoring/reporting system to a low power consumption mode or low power operating mode. For example, in at least one embodiment, while in the monitor state 704, the security monitoring/reporting system may be a in power down mode, conserving battery power.
- Monitor events, conditions and/or activities at the gaming device for detection of any security-related events and/or conditions and/or critical security events and/or conditions.
- Periodically record selected information associated with events, conditions and/or activities detected at the gaming device.
- Receive requests, commands and/or instructions from the security management system (and/or gaming device and/or other remote systems/devices).
- Implement or carry out requests, commands and/or instructions received from the security management system (and/or gaming device and/or other remote systems/devices).
- Etc.

According to different embodiments, various examples of security-related events and/or conditions may include for example, one or more of the following (or combinations thereof):

- Detection of one or more events, conditions and/or activities which meet or exceed specified "security-related" threshold criteria (e.g., detection of continuous motion exceeding a predetermined time interval, detection of fault condition exceeding a predetermined time interval, detection of access door movement exceeding predetermined displacement value, etc.).
- Detection of one or more events, conditions and/or activities which may result in damage to the gaming device.
- Detection of one or more events, conditions and/or activities which may result in loss or altering of information stored at the gaming device.
- Detection of one or more unauthorized events, conditions and/or activities at the gaming device.
- Detection of one or more events, conditions and/or activities relating to access of the interior of the gaming device.
- Detection of one or more events, conditions and/or activities relating to access of cash stored at the gaming device.
- Detection of one or more fault events or conditions at the gaming device.
- Etc.

In at least one embodiment, the gaming device may continue to remain in the monitor state 704 while no security-related events and/or conditions are detected (703).

In at least one embodiment, while in the monitor state 704, the detection of a security-related event or condition may trigger 705 a change to evaluation state 706. In some embodiments, while in the monitor state 704, the detection of a critical security event or condition may trigger 719 a change to security response state 712.

In at least one embodiment, while in the evaluation state 706, the security monitoring/reporting system (and/or selected systems, devices, components associated with the gaming device) may be operable to perform one or more of the following (or combinations thereof):

- Set or update a current power mode of operation of the security monitoring/reporting system. For example, in at least one embodiment, while in the evaluation state 704, the security monitoring/reporting system may be a in reduced power mode sufficient to allow the security monitoring/reporting system to perform an analysis of information relating to any detected events and/or conditions.
- Monitor events, conditions and/or activities at the gaming device for detection of any security-related events and/or conditions and/or critical security events and/or conditions.
- Periodically record selected critical security information associated with events, conditions and/or activities detected at the gaming device.
- Acquire and/or store selected information relating to gaming device in non-volatile memory. According to specific embodiments, the selected information may include, but are not limited to, one or more of the following (or combinations thereof): historical game data, critical information, game state data, wager related data, gaming device state information, gaming device movement data, critical security information, fault-related information, timestamp information, and/or other data or information which may be desired and/or used for reconstructing prior conditions, events, and/or states at the gaming device.
- Transmit selected information to one or more remote or external devices/systems. According to specific embodiments, the selected information may include, but are not limited to, one or more of the following (or combinations thereof): historical game data, critical information, game state data, wager related data, gaming device state information, gaming device movement data, critical security information, fault-related information, gaming device ID information, security monitoring/reporting system ID information, timestamp information, and/or other data or information which may be desired and/or used for reconstructing prior conditions, events, and/or states at the gaming device.
- Receive requests, commands and/or instructions from the security management system (and/or gaming device and/or other remote systems/devices).
- Implement or carry out requests, commands and/or instructions received from the security management system (and/or gaming device and/or other remote systems/devices).
- Automatically power-up the gaming device (e.g., if gaming device is in power-off, hibernate and/or standby mode).
- Automatically power-up selected components/devices of the gaming device.
- Automatically verification of location/position data.
- Etc.

In at least one embodiment, the gaming device may continue to remain in the evaluation state 706 while one or more security-related events and/or conditions are detected (709).

In at least one embodiment, while in the evaluation state 706, the detection of a critical security event or condition may trigger 711 a change to security response state 712. Additionally, in at least one embodiment, while in the evaluation state 706, non-detection of any security-related events and/or conditions may trigger 707 a change to monitor state 704.

According to different embodiments, various examples of critical security events and/or conditions may include for example, one or more of the following (or combinations thereof):

- Detection of one or more events, conditions and/or activities which meet or exceed specified "critical security" threshold criteria (e.g., detection of continuous motion exceeding a predetermined time interval, detection of fault condition exceeding a predetermined time interval, detection of access door movement exceeding predetermined displacement value, etc.).
- Detection of one or more events, conditions and/or activities which may result in damage to the gaming device.
- Detection of one or more events, conditions and/or activities which may result in loss or altering of information stored at the gaming device.
- Detection of one or more unauthorized events, conditions and/or activities at the gaming device.
- Detection of one or more events, conditions and/or activities relating to access of the interior of the gaming device.
- Detection of one or more events, conditions and/or activities relating to access of cash stored at the gaming device.
- Detection of one or more fault events or conditions at the gaming device.
- Detection of system shaking/tilting movement(s), high frequency pulses, etc.
- Etc.

In at least one embodiment, while in the security response state 712, the gaming device (and/or selected systems, devices, components associated therewith) may be operable to perform one or more of the following (or combinations thereof):

- Set or update a current power mode of operation of the security monitoring/reporting system. For example, in at least one embodiment, while in the security response state 712, the security monitoring/reporting system may be a normal or high power mode sufficient to allow the security monitoring/reporting system to perform any appropriate operations which may be desired and/or required to be performed in response to detection of one or more critical security events, conditions, and/or activities.
- Monitor events, conditions and/or activities at the gaming device for detection of any security-related events and/or conditions and/or critical security events and/or conditions.
- Periodically record selected critical security information associated with events, conditions and/or activities detected at the gaming device.
- Acquire and/or store selected information relating to gaming device in non-volatile memory. According to specific embodiments, the selected information may include, but are not limited to, one or more of the following (or combinations thereof): historical game data, critical information, game state data, wager related data, gaming device state information, gaming device movement data, critical security information, fault-related information, and/or other data or information which may be desired and/or used for reconstructing prior conditions, events, and/or states at the gaming device.
- Transmit (e.g., periodically, at specified times, in real-time, etc.) selected information to one or more remote or external devices/systems (such as, for example, a security management system). According to specific embodiments, the selected information may include, but are not limited to, one or more of the following (or combinations thereof): historical game data, critical information, game state data, wager related data, gaming device state information, gaming device movement data, critical security information, fault-related information, gaming device ID information, security monitoring/reporting system ID information, timestamp information, and/or other data or information which may be desired and/or used for reconstructing prior conditions, events, and/or states at the gaming device.

Receive requests, commands and/or instructions from the security management system (and/or gaming device and/or other remote systems/devices).

Implement or carry out requests, commands and/or instructions received from the security management system (and/or gaming device and/or other remote systems/devices).

Automatically power-up the gaming device (e.g., if gaming device is in power-off, hibernate and/or standby mode).

Automatically power-up selected components/devices of the gaming device.

Take appropriate action to prevent damage to one or more components or systems of the gaming device (such as, for example, suspending or shutting down one or more systems or components, parking hard drive heads, etc.).

Provide instructions for shutting down one or more components of the gaming device.

Record various data relating to detected critical security events and/or conditions such as, for example, the number of times the access door has been opened (e.g., during one or more specified time intervals), the number of times the cash box has been accessed, timestamp information, duration of detected critical security events and/or conditions, etc.

Disable the gaming device from play.

Etc.

In at least one embodiment, the security monitoring/reporting system may continue to remain in the security response state 712 while one or more critical security events and/or conditions are detected (715). For example, the security monitoring/reporting system may continue to remain in the security response state 712 while the gaming device access door is detected as being open.

Additionally, in at least one embodiment, while in security response state 712, the gaming device may continue to remain in the security response state 712 until all appropriate security response procedures/operations have been completed (717).

In at least one embodiment, while in the security response state 712, if it has been detected that all appropriate security response procedures have been completed, and at least one security-related event and/or condition is detected, a state change to the evaluation state 706 may be triggered 713. Additionally, in at least one embodiment, while in the security response state 712, if it has been detected that all appropriate security response procedures have been completed, and no security-related events and/or conditions are detected, a state change to the monitor state 704 may be triggered 721.

In at least one embodiment, a variety of different classifications may be used to characterize different types of security-related events/conditions detected at one or more gaming devices. For example, in one embodiment, a detected security-related events/conditions may be automatically and/or dynamically classified as either a critical security event/condition or a non-critical security event/condition. In at least one embodiment, the classification of a detected security-related event/condition may be based, at least in part, upon various other factors, events, conditions, and/or criteria. For example, in at least one embodiment, classification of a detected security-related event/condition may be based on one or more of the following (or combinations thereof):

operating state or mode of operation of the gaming device at the time of occurrence of the detected security-related event/condition;

other contemporaneous factors, events, and/or conditions which were in effect before, during, and/or after the occurrence of the detected security-related event/condition.

etc.

For example, in one embodiment, if a gaming device is currently in a "game play" mode of operation when an "access door open" event is detected by the security monitoring/reporting system, the event may be classified as a critical security event since, for example, typically it is not expected for the gaming device access door to be opened during game play. Alternatively, if the gaming device is currently in a "service" mode of operation when an "access door open" event is detected by the security monitoring/reporting system, the event may be classified as a non-critical security event. Similarly, such an event may be classified as a non-critical security event if one or more other conditions exist such as, for example, an authenticated key was used to open the access door; the person opening the access door has been authenticated and authorized; the access door has been authorized to be opened during a time interval corresponding to a time when the "access door open" event was detected; etc.

In one embodiment, the security monitoring/reporting system may be operable to determine a classification of a detected security-related event/condition. In some embodiments, the security management system may be operable to determine a classification of a detected security-related event/condition.

Additionally, in at least one embodiment, different types of appropriate actions or operations may be performed or initiated by the security monitoring/reporting system depending upon the classification of the type of security-related event/condition detected (e.g., critical, non-critical, etc.).

In at least one alternate embodiment (not shown), the security monitoring/reporting system may be configured or designed to omit the evaluation state (706) of operation. For example, in one such embodiment, the detection of any event, condition and/or activity which meets or exceeds predetermined threshold criteria (e.g., which, for example, may be used to evaluate whether the detected event/condition/activity qualifies as a critical (or non-critical) security-related event/condition/activity) may trigger the security monitoring/reporting system to advance from a monitor state directly to a security response state.

Various features of at least one security monitoring/reporting system embodiment may be illustrated by way of the following example. In this example, it is assumed that the security monitoring/reporting system has been installed in the interior of a gaming device, and is currently operating in a low-power monitor state (e.g., 704) of operation. In this example, the security monitoring/reporting system has been configured or designed to monitor the access door of the gaming device using one or more sensors. In one embodiment, when the security monitoring/reporting system detects an "access door open" event/condition (e.g., indicating that the access door is ajar or has been opened), the security monitoring/reporting system may change to a security response state (e.g., 712) of operation, whereupon the security monitoring/reporting system may perform (or cause to be performed) one or more of the following security response operations (or combinations thereof):

the security monitoring/reporting system processor is powered into normal mode;

log information relating to the "access door open" event to local non-volatile memory;

transmit information relating to the "access door open" event to the gaming device master controller (e.g., via a wired interface or via a wireless interface);

transmit (e.g., via a wireless interface) information relating to the "access door open" event to a remote security management system In at least one embodiment, once the security monitoring/reporting system has successfully performed the appropriate security response operations, the security monitoring/reporting system may return to the low-power monitor state (e.g., 704) of operation to conserve battery life.

In at least one embodiment, at least a portion of information which is transmitted by the security monitoring/reporting system (such as, for example, selected information sent via wireless transmission) may be encrypted, for example, using one or more commonly available encryption protocols.

In at least one embodiment, the security monitoring/reporting system may include a power distribution interface which may be used to allow the security monitoring/reporting system to utilize power provided by the gaming device. Additionally, in at least one embodiment, the security monitoring/reporting system may include a battery recharging system which, for example, may be configured or designed to recharge the security monitoring/reporting system's local power source (such as, for example, a rechargeable battery) using power obtained from the gaming device and/or other external power source.

Figure 8:
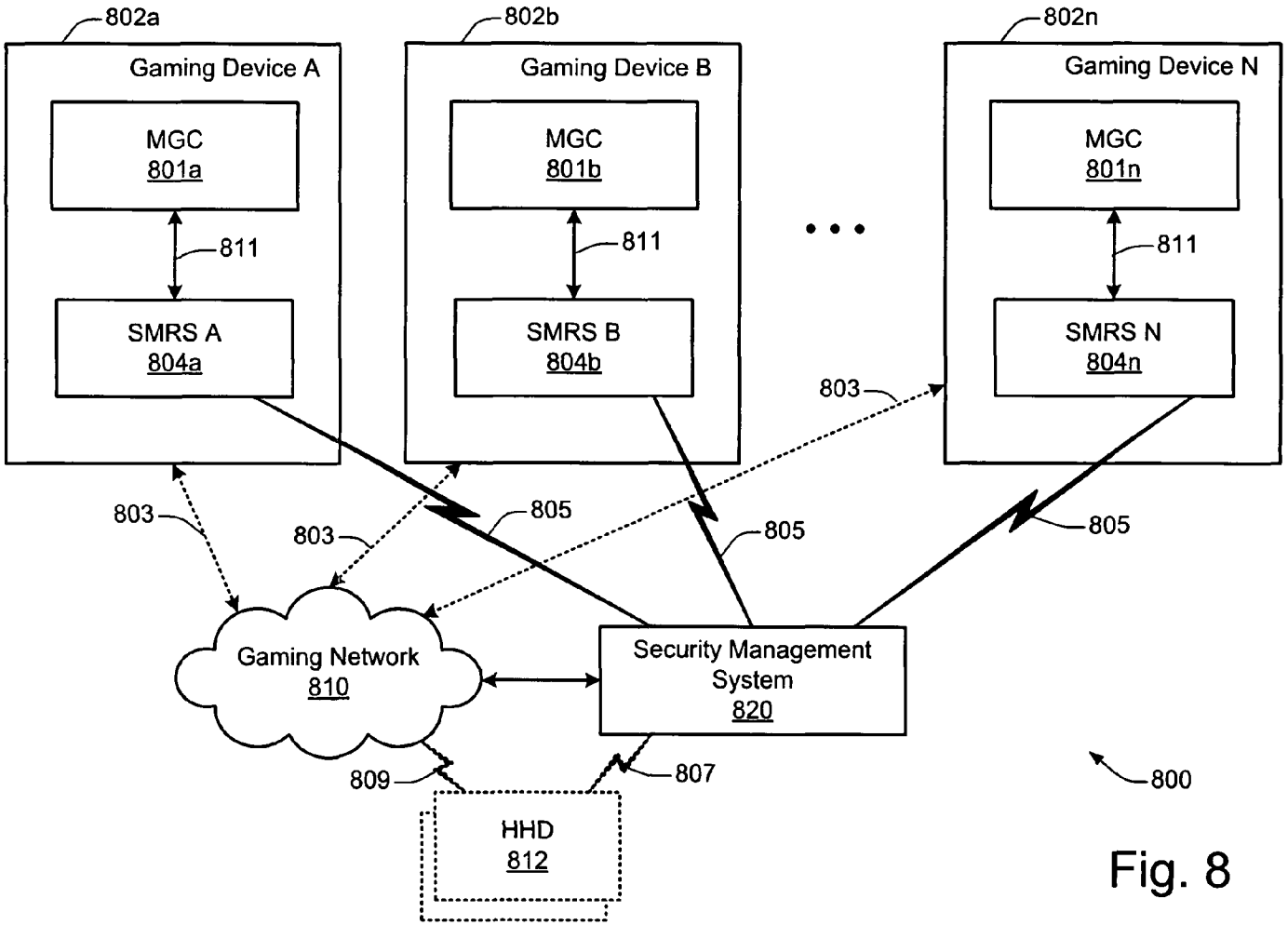
FIG. 8 shows an example embodiment of a portion 800 of a gaming network.

FIG. 8 shows an example embodiment of a portion 800 of a gaming network. In at least one embodiment, network portion 800 may be part of a casino gaming network. As illustrated in the example embodiment of FIG. 8, network portion 800 includes a plurality of gaming devices (e.g., 802*a*, 802*b*, 802*n*). In at least one embodiment, as shown, for example, in FIG. 8, each gaming device may include or be adapted to include a respective security monitoring/reporting system (e.g., 804*a*, 804*b*, 804*n*).

In at least one embodiment, each security monitoring/reporting system (e.g., 804*a*) may be configured or designed to communicate with the master game controller (e.g., 801*a*) (and/or other components) of its associated gaming device (e.g., 802*a*). Additionally, in at least one embodiment, each security monitoring/reporting system (e.g., 804*a*) may be configured or designed to communicate (e.g., via one or more wireless communication links 805) directly and/or indirectly with external devices/systems, such as, for example, security management system 820.

Additionally, as illustrated in the example of FIG. 8, one or more security monitoring/reporting systems (e.g., 804*a*) may be configured or designed to communicate (e.g., directly and/or indirectly) with one or more wireless or mobile handheld devices (e.g., 812). In at least one embodiment, one or more of the handheld devices may be implemented as two-way, wireless communication device compatible with one or more ZigBee Alliance specifications.

In at least one embodiment, the security management system (and/or gaming device and/or other external devices/systems) may be configured or designed to periodically poll one or more selected security monitoring/reporting systems for various information such as, for example, one or more of the following (or combinations thereof):

gaming device current operating mode or state information;

gaming device status information;

security-related status information;

security monitoring/reporting system status information;

and/or other desired information (such as, for example, various types of information described herein).

In at least one embodiment, the security management system may be configured or designed to communicate with multiple different security monitoring/reporting systems concurrently.

Additionally, in at least one embodiment, the security management system (and/or gaming device and/or other external devices/systems) may issue commands and/or instructions to one or more selected security monitoring/reporting systems to be implemented or carried out by the selected security monitoring/reporting systems. For example, in one embodiment, the security management system may be operable to analyze information received from a security monitoring/reporting system relating to a security related event detected at a gaming device, and may further be operable to generate appropriate commands and/or instructions (e.g., for performing specific operations in response to the detected security related event) to be transmitted to (and carried out by) the security monitoring/reporting system.

Figure 9:
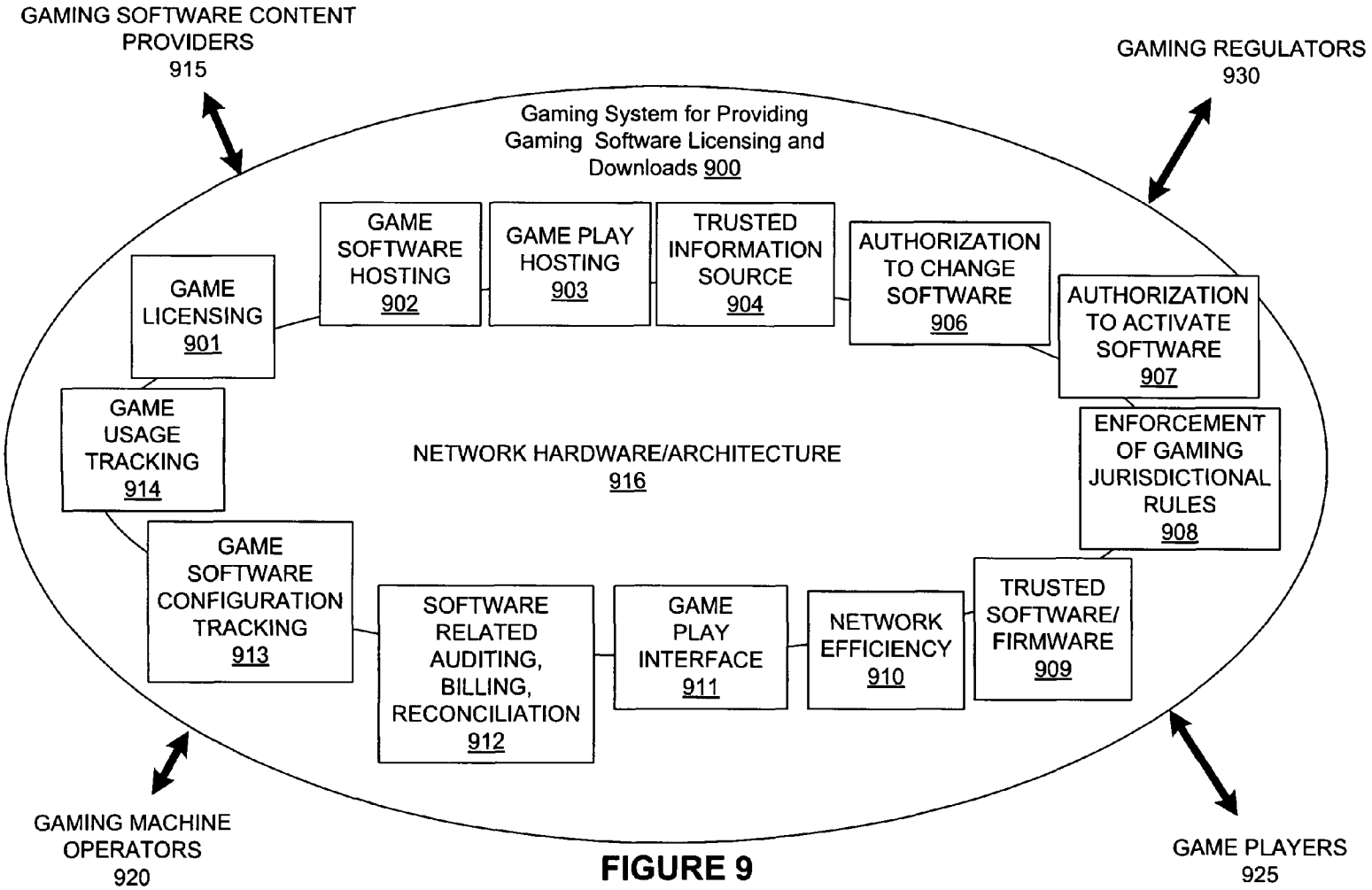
FIG. 9 shows a block diagram illustrating components of a gaming system 900 which may be used for implementing various aspects of example embodiments.

FIG. 9 shows a block diagram illustrating components of a gaming system 900 which may be used for implementing various aspects of example embodiments. In FIG. 9, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 9, only one instance of each function is shown. The functions of the components may be combined. For example, a single device may comprise the game play interface 911 and include trusted memory devices or sources 909.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers 915 provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 may provide rules and regulations that must be applied to the gaming system and may receive reports and other information confirming that rules are being obeyed.

In the following paragraphs, details of each component and some of the interactions between the components are described with respect to FIG. 9. The game software license host 901 may be a server connected to a number of remote gaming devices that provides licensing services to the remote gaming devices. For example, in other embodiments, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in utility based licensing schemes, such as a pay-per-use scheme.

In another embodiment, a game usage-tracking host 914 may track the usage of game software on a plurality of devices in communication with the host. The game usage-tracking host 914 may be in communication with a plurality of game play hosts and gaming machines. From the game play hosts and gaming machines, the game usage tracking host 914 may receive updates of an amount that each game available for play on the devices has been played and on amount that has been wagered per game. This information may be stored in a database and used for billing according to methods described in a utility based licensing agreement.

The game software host 902 may provide game software downloads, such as downloads of game software or game firmware, to various devious in the game system 900. For example, when the software to generate the game is not available on the game play interface 911, the game software host 902 may download software to generate a selected game of chance played on the game play interface. Further, the game software host 902 may download new game content to a plurality of gaming machines via a request from a gaming machine operator.

In one embodiment, the game software host 902 may also be a game software configuration-tracking host 913. The function of the game software configuration-tracking host is to keep records of software configurations and/or hardware configurations for a plurality of devices in communication with the host (e.g., denominations, number of paylines, paytables, max/min bets). Details of a game software host and a game software configuration host that may be used with example embodiments are described in co-pending U.S. Pat. No. 6,645,077, by Rowe, entitled, "Gaming Terminal Data Repository and Information System," filed Dec. 21, 2000, which is incorporated herein in its entirety and for all purposes.

A game play host device 903 may be a host server connected to a plurality of remote clients that generates games of chance that are displayed on a plurality of remote game play interfaces 911. For example, the game play host device 903 may be a server that provides central determination for a bingo game play played on a plurality of connected game play interfaces 911. As another example, the game play host device 903 may generate games of chance, such as slot games or video card games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

In particular embodiments, the game play interfaces or other gaming devices in the gaming system 900 may be devices, such as electronic tokens, cell phones, smart cards, tablet PC's and PDA's. The devices may support wireless communications and thus, may be referred to as wireless mobile devices. The network hardware architecture 916 may be enabled to support communications between wireless mobile devices and other gaming devices in gaming system. In one embodiment, the wireless mobile devices may be used to play games of chance.

The gaming system 900 may use a number of trusted information sources. Trusted information sources 904 may be devices, such as servers, that provide information used to authenticate/activate other pieces of information. CRC values used to authenticate software, license tokens used to allow the use of software or product activation codes used to activate to software are examples of trusted information that might be provided from a trusted information source 904. Trusted information sources may be a memory device, such as an EPROM, that includes trusted information used to authenticate other information. For example, a game play interface 911 may store a private encryption key in a trusted memory device that is used in a private key-public key encryption scheme to authenticate information from another gaming device.

When a trusted information source 904 is in communication with a remote device via a network, the remote device will employ a verification scheme to verify the identity of the trusted information source. For example, the trusted information source and the remote device may exchange information using public and private encryption keys to verify each other's identities. In another example of an embodiment, the remote device and the trusted information source may engage in methods using zero knowledge proofs to authenticate each of their respective identities. Details of zero knowledge proofs that may be used with example embodiments are described in US publication no. 2003/0203756, by Jackson, filed on Apr. 25, 2002 and entitled, "Authentication in a Secure Computerized Gaming System, which is incorporated herein in its entirety and for all purposes.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

The gaming system 900 of example embodiments may include devices 906 that provide authorization to download software from a first device to a second device and devices 907 that provide activation codes or information that allow downloaded software to be activated. The devices, 906 and 907, may be remote servers and may also be trusted information sources. One example of a method of providing product activation codes that may be used with example embodiments is describes in previously incorporated U.S. Pat. No. 6,264,561.

A device 906 that monitors a plurality of gaming devices to determine adherence of the devices to gaming jurisdictional rules 908 may be included in the system 900. In one embodiment, a gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRC's, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum bet limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. In one embodiment, when a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may used to check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, i.e., game software approved for use on gaming devices by a local gaming jurisdiction may be required on gaming devices on the gaming machine.

In example embodiments, the devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, in example embodiments, network efficient devices 910 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices in example embodiments may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. In one embodiment, the software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

There are many possible interactions between the components described with respect to FIG. 9. Many of the interactions are coupled. For example, methods used for game licensing may affect methods used for game downloading and vice versa. For the purposes of explanation, details of a few possible interactions between the components of the system 900 relating to software licensing and software downloads have been described. The descriptions are selected to illustrate particular interactions in the game system 900. These descriptions are provided for the purposes of explanation only and are not intended to limit the scope of example embodiments described herein.

Techniques and mechanisms described or reference herein will sometimes be described in singular form for clarity. However, it should be noted that particular embodiments include multiple iterations of a technique or multiple instantiations of a mechanism unless noted otherwise.

Additional details relating to various aspects of gaming technology are described in U.S. Pat. No. 6,641,484, by Oles et al., entitled "GAMING MACHINE INCLUDING SECURITY DATA COLLECTION DEVICE," the entirety of which is incorporated herein by reference for all purposes.

Although several example embodiments of one or more aspects and/or features have been described in detail herein with reference to the accompanying drawings, it is to be understood that aspects and/or features are not limited to these precise embodiments, and that various changes and modifications may be effected therein by one skilled in the art without departing from the scope of spirit of the invention as defined, for example, in the appended claims.

The invention claimed is:

1. A gaming device in a casino gaming network, comprising:

a gaming controller;

a first memory;

a display;

a first communication interface, the first communication interface operable to facilitate communication between the gaming device and one or more devices in the casino gaming network;

a gaming device housing including a door, said door movable between an open position and a closed position, when said door is in said closed position defining an interior area and when said door in said open position permitting access to said interior area, the interior area including one or more devices;

the interior area further including a security system, the security system including a security system housing, the security system housing including a processor, a second memory, a portable power source, a second communication interface, and a sensor;

the security system operable to:

detect a security-related event, wherein the security-related event indicates a condition of the security of the gaming device;

designate the detected security-related event as a critical security event or a non-critical security event;

automatically update a current power mode of operation of the security system, wherein the current power mode of operation indicates an amount of power consumed by the security system;

record selected information associated with the detected security-related event;

transmit the selected information associated with the detected security-related event via the second communication interface to a remote system, wherein the remote system is located external to the gaming device;

receive a command from the remote system, the command providing instructions for responding to the detected security-related event; and perform the command.

2. The gaming device of claim 1, wherein the first security system is further operable to:

acquire selected information relating to the gaming device, the selected information including at least a portion of information selected from a group consisting of: historical game data, game state data, wager related data, gaming device state information, gaming device movement data, security information, fault-related information, gaming device ID information, timestamp information, and security system ID information.

3. The gaming device of claim 1, wherein the selected information associated with the detected security-related event includes at least a portion of information selected from a group consisting of: historical game data, game state data, wager related data, gaming device state information, gaming device movement data, security information, fault-related information, gaming device ID information, timestamp information, and security system ID information.

4. The gaming device of claim 1, wherein the first security system is further operable to:

store selected information relating to the gaming device to a remote storage medium, wherein the remote storage medium is external to the gaming device, wherein the selected information includes at least a portion of information selected from a group consisting of: historical game data, game state data, wager related data, gaming device state information, gaming device movement data, security information, fault-related information, gaming device ID information, timestamp information, and security system ID information.

5. The gaming device of claim 1, wherein the security system is further operable to:

initiate, in response to detection of the security-related event, an action for shutting down one or more components of the gaming device.

6. The gaming device of claim 1, wherein the security system is further operable to:

initiate, in response to detection of the security-related event, an action for disabling game play at the gaming device.

7. The gaming device of claim 1:

wherein the security-related event includes at least one condition or event selected from a group consisting of: detection a first event at the gaming device which meets or exceeds specified threshold criteria, detection a first condition at the gaming device which meets or exceeds specified threshold criteria, detection of an event or condition at the gaming device which may result in damage to the gaming device, detection of an event or condition at the gaming device which may result in loss or altering of information stored at the gaming device, detection of an unauthorized event or condition at the gaming device, detection of an event or condition at the gaming device which relates to an access of the interior area of the gaming device, detection of an event or condition at the gaming device which relates to access of cash stored at the gaming device, and detection of a fault-related event or condition at the gaming device.

8. The gaming device of claim 1 further comprising an input mechanism for receiving cash or an indicia of credit.

9. The gaming device of claim 1 further comprising:

means for detecting the security-related event; means for designating the detected security-related event as a critical security event or a non-critical security event;

means for automatically updating a current power mode of operation of the security system;

means for recording selected information associated with the detected security-related event;

means for transmitting the selected information associated with the detected security-related event via the second communication interface to the remote system;

means for receiving a command from the remote system; and means for performing the command.

10. The gaming device of claim 1, wherein the security system is configured to:

collect image information of a security related event associated with the exterior of the gaming device.

11. The gaming device of claim 1, wherein the security system is configured to:

collect image information of a security-related event associated with the interior of the gaming device.

12. A gaming device for use in a casino gaming network, comprising:

a gaming controller;

a first memory;

a display;

a first communication interface, the first communication interface operable to facilitate communication between the gaming device and one or more devices in the gaming network; and a security system;

the gaming device is a hand held device;

the security system being operable to:

detect a first event relating to the gaming device, the first detected event having associated therewith a first set of data;

analyze the first set of data with respect to a first set of criteria to designate the first detected event as a critical security event or a non-critical security event, wherein the first detected event is designated as a critical security event when the first detected event meets or exceeds a specified threshold security criteria;

perform an action in response to determining that the first event corresponds to a critical security event, wherein the action includes recording selected information associated with the critical security event in non-volatile memory, and transmitting, via a wireless communication protocol, selected information relating to the critical security event to a remote system, wherein the remote system is located external to the gaming device;

receive a command from the remote system, the command providing instructions for responding to the critical security event; and perform the command.

13. The gaming device of claim 12, wherein the first security system is further operable to:

acquire selected information relating to the gaming device, the selected information including at least a portion of information selected from a group consisting of: historical game data, game state data, wager related data, gaming device state information, gaming device movement data, security information, fault-related information, gaming device ID information, timestamp information, and security system ID information.

14. The gaming device of claim 13 wherein the selected information includes at least a portion of information selected from a group consisting of: historical game data, game state data, wager related data, gaming device state information, gaming device movement data, security information, fault-related information, gaming device ID information, timestamp information, and security system ID information.

15. The gaming device of claim 12, wherein the security system is further operable to:

store a selected information relating to the gaming device to a remote storage medium, wherein the remote storage medium is external to the gaming device, wherein the selected information includes at least a portion of information selected from a group consisting of: historical game data, game state data, wager related data, gaming device state information, gaming device movement data, security information, fault-related information, gaming device ID information, timestamp information, and security system ID information.

16. The gaming device of claim 12, wherein the security system is further operable to:

initiate, in response to detection of the critical security event, an action for shutting down one or more components of the gaming device.

17. The gaming device of claim 12, wherein the security system is further operable to:

initiate, in response to detection of the critical security event, an action for disabling game play at the gaming device.

18. The gaming device of claim 12:

wherein the first detected event includes at least one condition or event selected from a group consisting of: detection a first event at the gaming device which meets or exceeds specified threshold criteria, detection a first condition at the gaming device which meets or exceeds specified threshold criteria, detection of an event or condition at the gaming device which may result in damage to the gaming device, detection of an event or condition at the gaming device which may result in loss or altering of information stored at the gaming device, detection of an unauthorized event or condition at the gaming device, detection of an event or condition at the gaming device which relates to an access of the interior area of the gaming device, detection of an event or condition at the gaming device which relates to access of cash stored at the gaming device, and detection of a fault-related event or condition at the gaming device.

19. The gaming device of claim 12 further comprising:

means for detecting a first event relating to the gaming device, the first detected event having associated therewith a first set of data;

means for analyzing the first set of data with respect to a first set of criteria to designate the first detected event as a critical security event or a non-critical security event, wherein the first detected event is designated as a critical security event when the first detected event meets or exceeds specified threshold security criteria; and means for performing at least one action in response to determining that the first event corresponds to a critical security event, wherein the at least one action includes recording selected information associated with the critical security event in non-volatile memory, and transmitting, via a wireless communication protocol, selected information relating to the critical security event to a remote system, wherein the remote system is located external to the gaming device.

20. A method for operating a gaming device in a casino gaming network, the gaming device including a gaming controller, a first memory, a display, a first communication interface, a gaming device housing including a door, said door being movable between an open position and a closed position, when said door is in said closed position defining an interior area and when said door in said open position permitting access to said interior area, the interior area including one or more devices, the interior area further including a security system, the security system including a security system housing, the security system housing including a processor, a second memory, a portable power source, a second communication interface a sensor, the method comprising:

detecting, by the security system, a security-related event;

designating, by the security system, the detected security-related event as a critical security event or a non-critical security event;

automatically updating, by the security system, a current power mode of operation of the security system;

recording, by the security system, selected information associated with the detected security-related event;

transmitting the selected information associated with the detected security-related event via the second communication interface to a remote system, wherein the remote system is located external to the gaming device;

receiving, by the security system, a command from the remote system, the command providing instructions for responding to the detected security-related event; and performing, by the security system, the command.

21. A method for operating a gaming device in a casino gaming network, the gaming device including a gaming controller, a first memory, a display, a first communication interface, and a security system, the method comprising:

detecting, by the security system, a first event relating to the gaming device, the first detected event having associated therewith a first set of data;

analyzing, by the security system, the first set of data with respect to a first set of criteria to designate the first detected event as a critical security event or a non-critical security event, wherein the first detected event is designated as a critical security event when meets or exceeds a specified threshold security criteria;

performing, by the security system, an action in response to determining that the first event corresponds to a critical security event, wherein the action includes recording selected information associated with the critical security event in non-volatile memory, and transmitting, via a wireless communication protocol, selected information relating to the critical security event to a remote system, wherein the remote system is located external to the gaming device;

receiving, by the security system, a command from the remote system, the command providing instructions for responding to the critical security event; and performing the command.

* * * * *

UNITED STATES PATENT AND TRADEMARK OFFICE

CERTIFICATE OF CORRECTION

PATENT NO. : 8,892,469 B2
APPLICATION NO. : 12/416608
DATED : November 18, 2014
INVENTOR(S) : Floyd R. Goldstein et al.

It is certified that error appears in the above-identified patent and that said Letters Patent is hereby corrected as shown below:

IN THE CLAIMS

In Claim 1, Column 54, Line 61, after ";" insert --and--.
In Claim 1, Column 54, Line 65, between "door" and "in" insert --is--.
In Claim 2, Column 55, Line 28, delete "first".
In Claim 2, Column 55, Line 32, replace "a" with --the--.
In Claim 3, Column 55, Line 41, replace "a" with --the--.
In Claim 4, Column 55, Line 52, replace "a" with --the--.
In Claim 7, Column 56, Line 3, replace "a" with --the--.
In Claim 7, Column 56, Line 4, between "detection" and "a" insert --of--.
In Claim 7, Column 56, Line 5, between "detection" and "a" insert --of--.
In Claim 10, Column 56, Line 38, replace the first instance of "the" with --an--.
In Claim 11, Column 56, Line 42, between "interior" and "of" insert --area--.
In Claim 12, Column 56, Lines 50 to 51, between the second instance of "the" and "gaming" insert --casino--.
In Claim 13, Column 57, Line 9, delete "first".
In Claim 13, Column 57, Line 13, replace "a" with --the--.
In Claim 14, Column 57, Line 22, replace "a" with --the--.
In Claim 15, Column 57, Line 34, replace "a" with --the--.
In Claim 18, Column 57, Line 52, replace "a" with --the--.
In Claim 18, Column 57, Line 53, between "detection" and "a" insert --of--.
In Claim 18, Column 57, Line 54, between "detection" and "a" insert --of--.
In Claim 20, Column 58, Line 26, between "door" and "in" insert --is--.
In Claim 20, Column 58, Line 32, between "interface" and "a" insert --, and--.
In Claim 21, Column 58, Line 60, between "when" and "meets" insert --it--.

Signed and Sealed this
Thirteenth Day of October, 2015

Michelle K. Lee

Michelle K. Lee
*Director of the United States Patent and Trademark Office*